US008554128B2

(12) United States Patent
Fukatsu et al.

(10) Patent No.: US 8,554,128 B2
(45) Date of Patent: Oct. 8, 2013

(54) SHEET PROCESSING APPARATUS HAVING A SHEET INSERTION FUNCTION, CONTROL METHOD THEREFOR, IMAGE FORMING APPARATUS, AND PROGRAM FOR IMPLEMENTING THE CONTROL METHOD

(75) Inventors: Yasuo Fukatsu, Abiko (JP); Norifumi Miyake, Kashiwa (JP); Takayuki Fujii, Toshima-ku (JP); Tsuyoshi Moriyama, Toride (JP); Takako Hanada, Yokohama (JP); Kuniyasu Kimura, Toride (JP); Toshiyuki Miyake, Toride (JP)

(73) Assignee: Canon Kabushiki Kaisha (JP)

( * ) Notice: Subject to any disclaimer, the term of this patent is extended or adjusted under 35 U.S.C. 154(b) by 8 days.

(21) Appl. No.: 12/246,106

(22) Filed: Oct. 6, 2008

(65) Prior Publication Data

US 2009/0041522 A1 Feb. 12, 2009

Related U.S. Application Data

(62) Division of application No. 11/088,239, filed on Mar. 23, 2005, now Pat. No. 7,447,477.

(30) Foreign Application Priority Data

Mar. 24, 2004 (JP) ..... 2004-088101

(51) Int. Cl.
*G03G 15/00* (2006.01)

(52) U.S. Cl.
USPC ..... 399/407; 399/408; 399/382; 399/393; 271/65; 412/19

(58) Field of Classification Search
USPC ..... 399/407, 408, 382, 393, 389; 270/58.31; 271/186, 185, 184; 412/19
See application file for complete search history.

(56) References Cited

U.S. PATENT DOCUMENTS 4,941,023 A 7/1990 Holmes et al.
5,257,081 A 10/1993 Kato et al.

(Continued)

FOREIGN PATENT DOCUMENTS

JP 10-198105 A 7/1998
JP 2000-89613 A 3/2000

(Continued)

*Primary Examiner* — Matthew G Marini
(74) *Attorney, Agent, or Firm* — Rossi, Kimms & McDowell LLP

(57) ABSTRACT

A sheet processing apparatus which is capable of improving operability while suppressing an increase in apparatus size. In a front cover insertion mode, an insertion sheet for a front cover is inserted into a bundle of sheets on which images have been formed, and in a rear cover insertion mode, an insertion sheet for a rear cover is inserted into the bundle of sheets. Insertion sheets for the front cover and insertion sheets for the rear cover are set with the same orientation in a manual feed tray 105. An insertion sheet for the front cover stored in the manual feed tray 105 is conveyed to a finisher 500 in one of a face-down state and a face-up state. An insertion sheet for the rear cover stored in the manual feed tray 105 is conveyed to the finisher 500 in the other of the face-down state and the face-up state. The insertion sheets for the front cover and for the rear cover conveyed from the manual feed tray 105 and the sheets on which images have been formed are stacked on the finisher 500.

9 Claims, 37 Drawing Sheets

(56) References Cited

U.S. PATENT DOCUMENTS

| | | | | |
|---|---|---|---|---|
| 5,316,279 | A | 5/1994 | Corona et al. | |
| 5,417,535 | A | 5/1995 | Andjelic et al. | |
| 6,823,154 | B2 * | 11/2004 | Koga et al. | 399/110 |
| 7,020,430 | B2 | 3/2006 | Kudo et al. | |
| 2001/0018626 | A1 | 8/2001 | Moriyama et al. | |
| 2003/0170059 | A1 | 9/2003 | Koga et al. | |
| 2003/0235446 | A1 | 12/2003 | Kudo et al. | |
| 2004/0022564 | A1 * | 2/2004 | Fujii et al. | 399/382 |

FOREIGN PATENT DOCUMENTS

| | | | |
|---|---|---|---|
| JP | 2003-160272 | A | 6/2003 |
| JP | 2004-026323 | A | 1/2004 |

* cited by examiner

SHEET PROCESSING APPARATUS HAVING A SHEET INSERTION FUNCTION, CONTROL METHOD THEREFOR, IMAGE FORMING APPARATUS, AND PROGRAM FOR IMPLEMENTING THE CONTROL METHOD

This is a divisional of U.S. patent application Ser. No. 11/088,239 filed Mar. 23, 2005, which claims priority from Japanese Patent Application No. 2004-088101 filed Mar. 24, 2004. The contents of each are incorporated herein by reference.

BACKGROUND OF THE INVENTION

1. Field of the Invention

The present invention relates to a sheet processing apparatus and a control method therefor that generates a sheet bundle by placing an insertion sheet on sheets that have been subjected to image formation and discharged from an image forming apparatus, as well as an image forming apparatus, and a program for implementing the control method.

2. Description of the Related Art

Conventionally, there is known an image forming apparatus, such as a copier, where a sheet, such as a color sheet, an OHP sheet, or a pre-printed sheet on which printing has been carried out, placed on a manual feed tray can be inserted at a specified page in a sheet bundle discharged from the image forming apparatus and where a sheet that has been subjected to image formation by a color image forming apparatus can be inserted into a sheet bundle having been subjected to image formation by an image forming apparatus capable of only black and white output. This image forming apparatus has modes such as a front cover mode where a sheet is inserted at a front page of a sheet bundle, a back cover mode where a sheet is inserted at a final page of a sheet bundle, and an interleaving mode where a sheet is inserted at a desired page between the front page and the final page of a sheet bundle, and therefore a sheet can be inserted at a desired page in a sheet bundle.

A sheet inserter that is connected to a sheet discharge side of an image forming apparatus is also known. The inserter has a cassette in which sheets to be inserted are stored, receives recording sheets on which image formation has been performed after discharge from the image forming apparatus, inserts a sheet fed from the cassette between desired recording sheets, and then discharges a sheet bundle in which the sheet has been inserted according to the cover mode, the interleaving mode, or the like from a discharge opening thereof.

A post-processing apparatus that is connected to an image forming apparatus and includes, in addition to a cassette that stores insertion sheets, a finisher that carries out a sheet aligning process and/or a binding process is also known. This post-processing apparatus combines the functions of a finisher and inserter. An image forming apparatus that can clearly inform the user of a difference in orientation of a cover is also known (see Japanese Laid-Open Patent Publication (Kokai) No. 2000-89613).

However, the various conventional apparatuses described above have the following problem. When sheets are inserted as the front cover and the back cover of a sheet bundle, if there is only one sheet insertion tray such as a manual feed tray or an inserter, it will be necessary for the user to change the orientation of the insertion sheets so as to be alternately face up and face down, so that there has been an operability problem in that it is troublesome to set the sheets.

To cope with this, it would be conceivable to provide two inserters, to set sheets in a face-up state as front covers in a one inserter, and to set sheets in a face-down state as back covers in the other inserter. However, since two inserters are provided in this case, the apparatus size is increased and there can be an increase in cost.

SUMMARY OF THE INVENTION

It is a first object of the present invention to provide a sheet processing apparatus, a control method therefor, and an image forming apparatus which are capable of improving operability while suppressing an increase in apparatus size, as well as a program for implementing the control method.

It is a second object of the present invention to provide a sheet processing apparatus, a control method therefor, and an image forming apparatus which permit insertion sheets for a front cover and insertion sheets for a rear cover to be set with the same orientation without having to set the insertion sheets so as to be alternately face-up and face-down in advance, as well as a program for implementing the control method.

To attain the above objects, in a first aspect of the present invention, there is provided a sheet processing apparatus capable of executing at least one of a front cover insertion mode in which an insertion sheet for a front cover is inserted into a bundle of sheets on which images have been formed and a rear cover insertion mode in which an insertion sheet for a rear cover is inserted into a bundle of sheets on which images have been formed, comprising an insertion sheet storing section that stores insertion sheets for the front cover and insertion sheets for the rear cover, the insertion sheets for the front cover and the insertion sheets for the rear cover being set with a same orientation in the insertion sheet storing section, a sheet stacking tray on which at least one of the insertion sheets for the front cover and the insertion sheets for the rear cover conveyed from the insertion sheet storing section and the sheets on which images have been formed are stacked, a first conveying section that conveys one of the insertion sheets for the front cover and the insertion sheets for the rear cover stored in the insertion sheet storing section to the sheet stacking tray in a face-down state, a second conveying section that conveys the other of the insertion sheets for the front cover and the insertion sheets for the rear cover stored in the insertion sheet storing section to the sheet stacking tray in a face-up state, and a conveying controller that causes one of the first conveying section and the second conveying section to convey the insertion sheets for the front cover and causes the other of the first conveying section and the second conveying section to convey the insertion sheets for the rear cover.

Preferably, the sheet processing apparatus further comprises an image forming section that forms an image on a sheet and a double-sided conveying section that conveys the sheet, on one side of which an image has been formed by the image forming section to the image forming section again, to have an image formed on another side of the sheet by the image forming section, each of the first conveying section and the second conveying section includes the double-sided conveying section.

To attain the above objects, in a second aspect of the present invention, there is provided a sheet processing apparatus comprising an insertion sheet storing section that stores insertion sheets to be inserted into a bundle of sheets on which images have been formed, at desired pages thereof, the insertion sheets comprising a plurality of types of insertion sheets and being set with a same orientation in the insertion sheet storing section, a sheet stacking tray on which the insertion sheets conveyed from the insertion sheet storing section and the sheets on which images have been formed are stacked, a sheet inserting section that inserts at least one of the insertion sheets into a bundle of sheets on which images have been formed and which are to be stacked on the sheet stacking tray, an insertion sheet inverting section that inverts front and rear sides of at least one of the insertion sheets conveyed from the insertion sheet storing section, a sheet insertion controller that controls the sheet inserting section to insert each of the insertion sheets into a bundle of the sheets on which images have been formed, at a desired page thereof, and an insertion sheet inversion controller that controls the insertion sheet inverting section to invert the front and rear sides of at least one of the insertion sheets conveyed from the insertion sheet storing section in accordance with a type of the insertion sheet.

To attain the above objects, in a third aspect of the present invention, there is provided an image forming apparatus comprising an image forming section that forms an image on a sheet, an insertion sheet storing section that stores insertion sheets for the front cover and insertion sheets for the rear cover, the insertion sheets for the front cover and the insertion sheets for the rear cover being set with a same orientation in the insertion sheet storing section, a sheet stacking tray on which at least one of the insertion sheets for the front cover and the insertion sheets for the rear cover conveyed from the insertion sheet storing section and sheets on which images have been formed by the image forming section are stacked, a first conveying section that conveys one of the insertion sheets for the front cover and the insertion sheets for the rear cover stored in the insertion sheet storing section to the sheet stacking tray in a face-down state, a second conveying section that conveys the other of the insertion sheets for the front cover and the insertion sheets for the rear cover stored in the insertion sheet storing section to the sheet stacking tray in a face-up state, and a conveying controller that causes one of the first conveying section and the second conveying section to convey the insertion sheets for the front cover and causes the other of the first conveying section and the second conveying section to convey the insertion sheets for the rear cover.

To attain the above objects, in a fourth aspect of the present invention, there is provided an image forming apparatus comprising an image forming section that forms an image on a sheet, an insertion sheet storing section that stores insertion sheets to be inserted into a bundle of sheets on which images have been formed by the image forming section, at desired pages thereof, the insertion sheets comprising a plurality of types of insertion sheets and being set with a same orientation in the insertion sheet storing section, a sheet stacking tray on which the insertion sheets conveyed from the insertion sheet storing section and the sheets on which images have been formed by the image forming section are stacked, a sheet inserting section that inserts at least one of the insertion sheets into a bundle of sheets on which images have been formed by the image forming section and which are to be stacked on the sheet stacking tray, an insertion sheet inverting section that inverts front and rear sides of at least one of the insertion sheets conveyed from the insertion sheet storing section, a sheet insertion controller that controls the sheet inserting section to insert each of the insertion sheets into a bundle of the sheets on which images have been formed by the image forming section, at a desired page thereof, and an insertion sheet inversion controller that controls the insertion sheet inverting section to invert the front and rear sides of at least one of the insertion sheets conveyed from the insertion sheet storing section in accordance with a type of the insertion sheet.

To attain the above objects, in a fifth aspect of the present invention, there is provided a control method for a sheet processing apparatus which includes an insertion sheet storing section that stores insertion sheets for a front cover and insertion sheets for a rear cover, the insertion sheets for the front cover and the insertion sheets for the rear cover being set with a same orientation in the insertion sheet storing section, and a sheet stacking tray on which at least one of the insertion sheets for the front cover and the insertion sheets for the rear cover conveyed from the insertion sheet storing section and sheets on which images have been formed are stacked, the sheet processing apparatus being capable of executing at least one of a front cover insertion mode in which an insertion sheet for the front cover is inserted into a bundle of sheets on which images have been formed and a rear cover insertion mode in which an insertion sheet for the rear cover is inserted into a bundle of sheets on which images have been formed, comprising a first conveying step of causing a first conveying section to convey one of the insertion sheets for the front cover and the insertion sheets for the rear cover stored in the insertion sheet storing section to the sheet stacking tray in a face-down state, a second conveying step of causing a first conveying section to convey the other of the insertion sheets for the front cover and the insertion sheets for the rear cover stored in the insertion sheet storing section to the sheet stacking tray in a face-up state, and a conveying controlling step of causing one of the first conveying section and the second conveying section to convey the insertion sheets for the front cover and causes the other of the first conveying section and the second conveying section to convey the insertion sheets for the rear cover.

To attain the above objects, in a sixth aspect of the present invention, there is provided a control method for a sheet processing apparatus which includes an insertion sheet storing section that stores insertion sheets to be inserted into a bundle of sheets on which images have been formed, at desired pages thereof, the insertion sheets comprising a plurality of types of insertion sheets and being set with a same orientation in the insertion sheet storing section, and a sheet stacking tray on which the insertion sheets conveyed from the insertion sheet storing section and the sheets on which images have been formed are stacked, comprising an insertion sheet inverting step of inverting front and rear sides of at least one of the insertion sheets conveyed from the insertion sheet storing section in accordance with a type of the insertion sheet, and a sheet inserting step of inserting each of the insertion sheets into a bundle of the sheets on which images have been formed and which are to be stacked on the sheet stacking tray, at a desired page thereof.

To attain the above objects, in a seventh aspect of the present invention, there is provided a program executable by a computer for implementing a control method for a sheet processing apparatus which includes an insertion sheet storing section that stores insertion sheets for a front cover and insertion sheets for a rear cover, the insertion sheets for the front cover and the insertion sheets for the rear cover being set with a same orientation in the insertion sheet storing section, and a sheet stacking tray on which at least one of the insertion sheets for the front cover and the insertion sheets for the rear cover conveyed from the insertion sheet storing section and sheets on which images have been formed are stacked, the sheet processing apparatus being capable of executing at least one of a front cover insertion mode in which an insertion sheet for the front cover is inserted into a bundle of sheets on which images have been formed and a rear cover insertion mode in which an insertion sheet for the rear cover is inserted into a bundle of sheets on which images have been formed, comprising a first conveying step of causing a first conveying section to convey one of the insertion sheets for the front cover and the insertion sheets for the rear cover stored in the insertion sheet storing section to the sheet stacking tray in a face-down state, a second conveying step of causing a first conveying section to convey the other of the insertion sheets for the front cover and the insertion sheets for the rear cover stored in the insertion sheet storing section to the sheet stacking tray in a face-up state, and a conveying controlling step of causing one of the first conveying section and the second conveying section to convey the insertion sheets for the front cover and causes the other of the first conveying section and the second conveying section to convey the insertion sheets for the rear cover.

To attain the above objects, in a eighth aspect of the present invention, there is provided a program executed by a computer for implementing a control method for a sheet processing apparatus which includes an insertion sheet storing section that stores insertion sheets to be inserted into a bundle of sheets on which images have been formed, at desired pages thereof, the insertion sheets comprising a plurality of types of insertion sheets and being set with a same orientation in the insertion sheet storing section, and a sheet stacking tray on which the insertion sheets conveyed from the insertion sheet storing section and the sheets on which images have been formed are stacked, comprising an insertion sheet inverting step of inverting front and rear sides of at least one of the insertion sheets conveyed from the insertion sheet storing section in accordance with a type of the insertion sheet, and a sheet inserting step of inserting each of the insertion sheets into a bundle of the sheets on which images have been formed and which are to be stacked on the sheet stacking tray, at a desired page thereof.

The above and other objects, features, and advantages of the invention will become more apparent from the following detailed description taken in conjunction with the accompanying drawings.

DETAILED DESCRIPTION OF THE PREFERRED EMBODIMENTS

The present invention will now be described in detail below with reference to the accompanying drawings showing preferred embodiments thereof.

Figure 1:
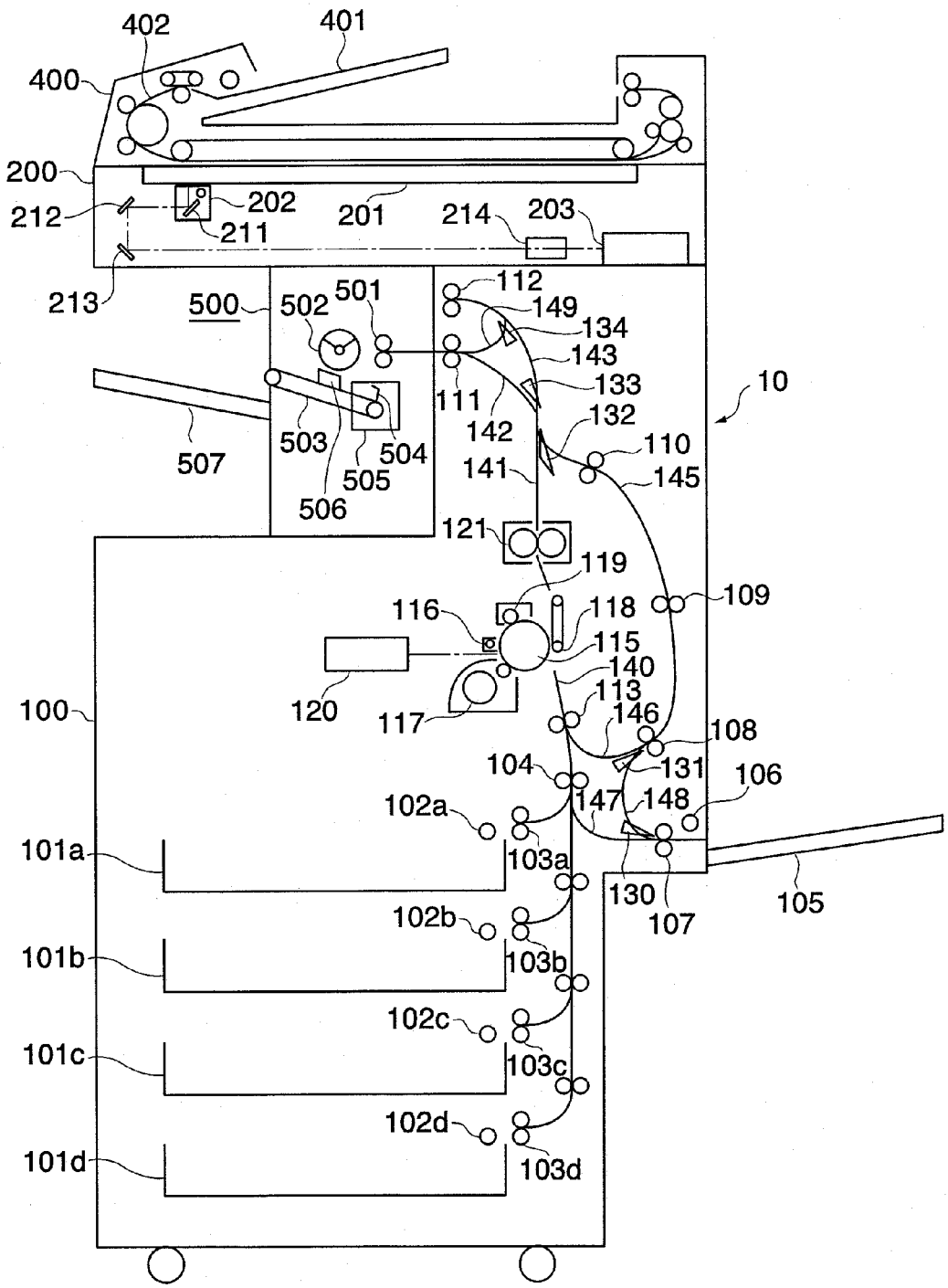
FIG. 1 is a diagram showing the construction of an image forming apparatus according to a first embodiment of the present invention.

FIG. 1 is a diagram showing the construction of an image forming apparatus according to a first embodiment of the present invention. The image forming apparatus 10 is comprised of an image forming apparatus main body, which includes a printer 100 and an image reader 200, and a finisher 500 as the sheet processing apparatus. An original feeding device 400 is mounted on the image reader 200 and feeds originals set face-up on an original tray 401 one at a time in order from an uppermost original leftward as viewed in FIG. 1 via a curved path 402 and stops the fed original at a predetermined position on a platen glass 201. In this state, the original is read by causing a scanner unit 202 to scan from left to right.

When the scanner unit 202 scans the original, the read surface of the original is irradiated with lamp light from the scanner unit 202 and light reflected by the original is guided via mirrors 211, 212, 213 to a lens 214, passes through the lens 214 and forms an image on an image pickup surface of an image sensor 203. The optically read image is converted to an image signal and outputted by the image sensor 203. The image signal outputted from the image sensor 203 is subjected to predetermined image processing by an image signal controller 281 (see FIG. 5), and is then inputted as a video signal to an exposure controller 120 inside the printer 100.

Figure 2:
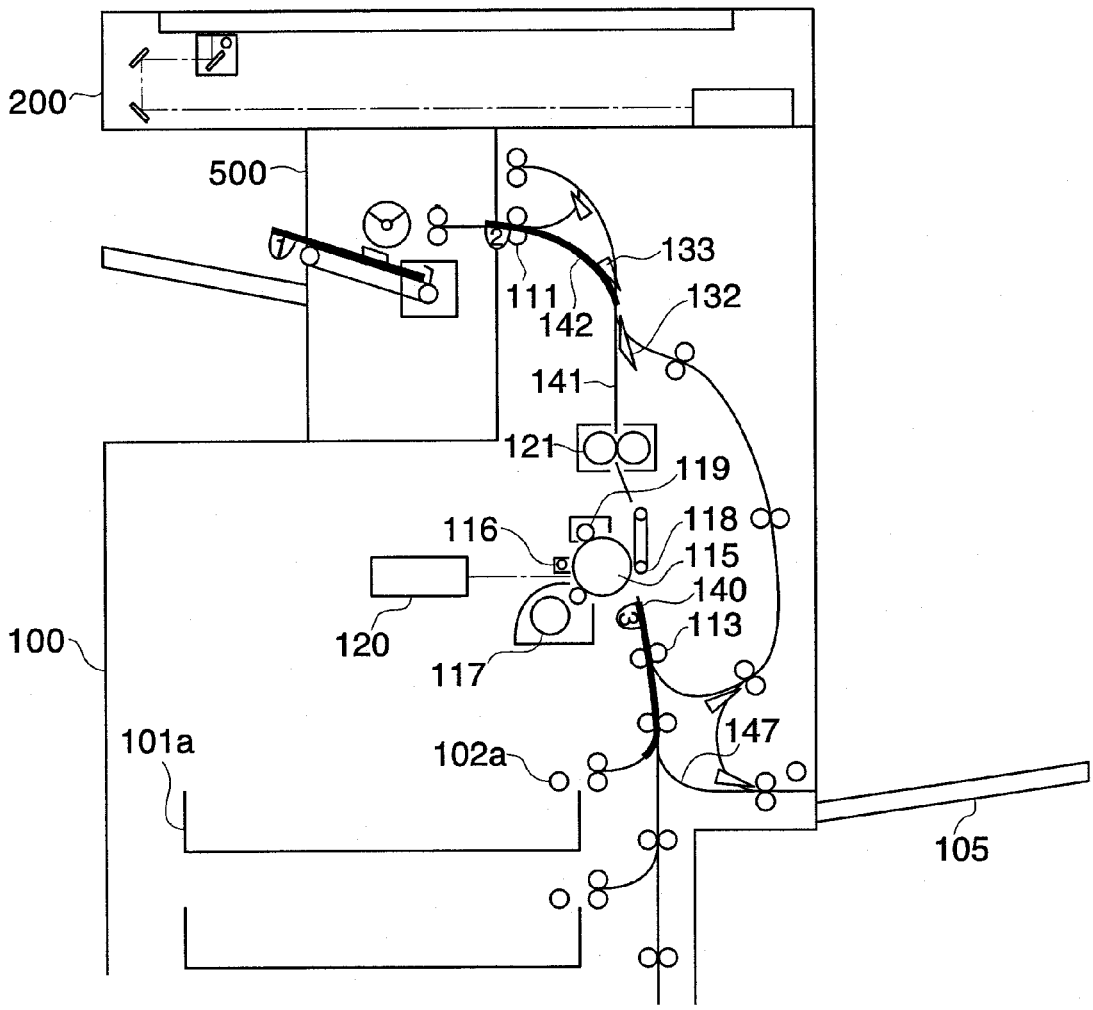
FIG. 2 is a diagram showing a sheet conveying operation in a single-sided mode in the image forming apparatus shown in FIG. 1.

FIG. 2 is a diagram showing a sheet conveying operation in a single-sided mode in which images are formed on only one side of sheets in the image forming apparatus 10. The exposure controller 120 inside the printer 100 modulates and outputs laser light based on the inputted video signal. This laser light is scanned by a polygon mirror, not shown, to be irradiated onto a photosensitive drum 115. An electrostatic latent image is formed on the photosensitive drum 115 in accordance with the scanning of the laser light. This electrostatic latent image on the photosensitive drum 115 is converted to a visible image (a developer image) using a developer supplied from a developing unit 117.

After a sheet fed from one of cassettes 101*a* to 101*d* or a sheet fed from a manual feed tray 105 via a conveying path 147 is stopped with a leading edge of the sheet abutting a registration roller 113, the sheet is conveyed between the photosensitive drum 115 and a transfer section 118 in timing synchronized with a start of irradiation of the laser light. The developer image formed on the photosensitive drum 115 is transferred onto the fed sheet in the transfer section 118. By having the conveying of the sheet temporarily stop with the leading edge of the sheet abutting the registration roller 113, any skewing of the sheet is corrected.

When the sheet onto which the developer image has been transferred has been conveyed to a fixing section 121, the developer image is fixed to the sheet through the application of heat and pressure by the fixing section 121. The sheet that has passed the fixing section 121 is guided by a flapper 133 to a conveying path 142 and is discharged via a discharge roller 111 from the printer 100 to the external finisher 500. At this time, the sheet is discharged in a so-called "face-down" state where the surface on which an image has been formed faces down, and accordingly, if image formation is carried out in order from the uppermost original, the order of a bundle of discharged sheets will be the correct page order, that is, the order in which image formation is carried out. Note that in FIG. 2, for ease of explanation, numerals showing page numbers are added to the surfaces of the sheets (here, numerals showing pages "1", "2", and "3" are added to the (upper) surfaces of the sheets). Such numerals are used in the same way in the following drawings.

FIGS. 3A to 3G are diagrams showing a conveying operation for a sheet in a double-sided mode in which images are formed on both sides of the sheet. In the same way as the single-sided mode, after a sheet fed from one of the cassettes 101*a* to 101*d* or a sheet fed from the manual feed tray 105 via the conveying path 147 is stopped with the leading edge of the sheet abutting the registration roller 113, the sheet is conveyed between the photosensitive drum 115 and the transfer section 118. In the transfer section 118, a developer image formed on the photosensitive drum 115 is transferred onto the fed sheet (a surface that is a second page). When the sheet passes the fixing section 121, an image is formed on one surface of the sheet.

Figure 3B:
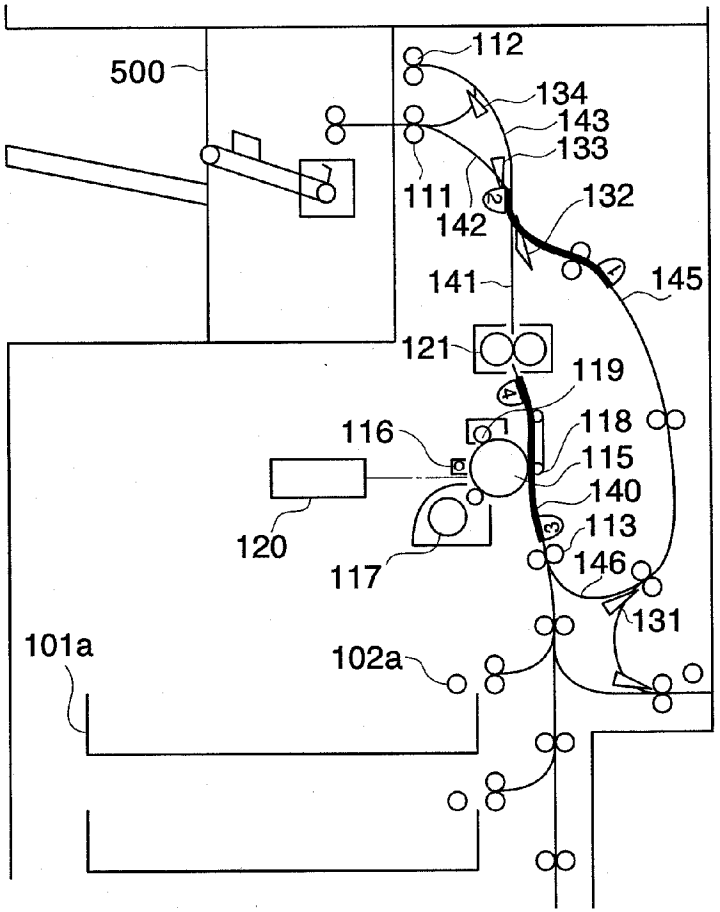
FIGS. 3A to 3G are diagrams showing a sheet conveying operation in a double-sided mode in the image forming apparatus.
Figure 3A:
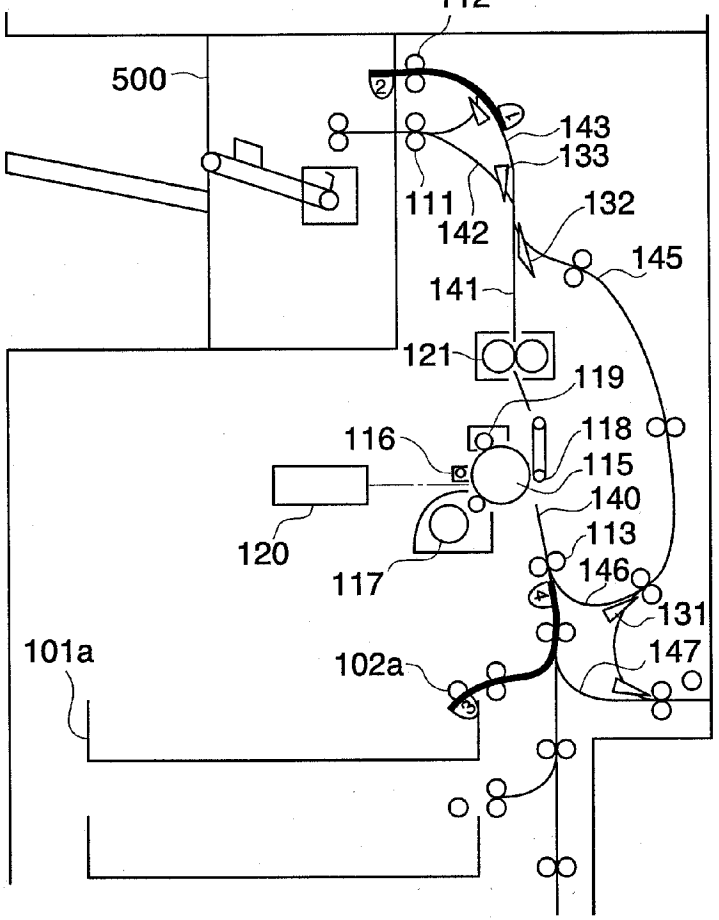

By switching an orientation of the flapper 133, the sheet is guided from a conveying path 141 to a conveying path 143, with the sheet being stopped in a state where the leading edge of the sheet is inserted between a nip of inverting rollers 112 (see FIG. 3A). When the orientation of the flapper 133 has been switched, the inverting rollers 112 are driven in reverse and the sheet is guided from the conveying path 143 to a double-sided conveying path 145 (see FIG. 3B), guided to a conveying path 146 by a flapper 131, and again stops with the leading edge of the sheet abutting the registration roller 113 (see FIG. 3C). At this time, the front and rear sides of the sheet are inverted.

Figure 3D:
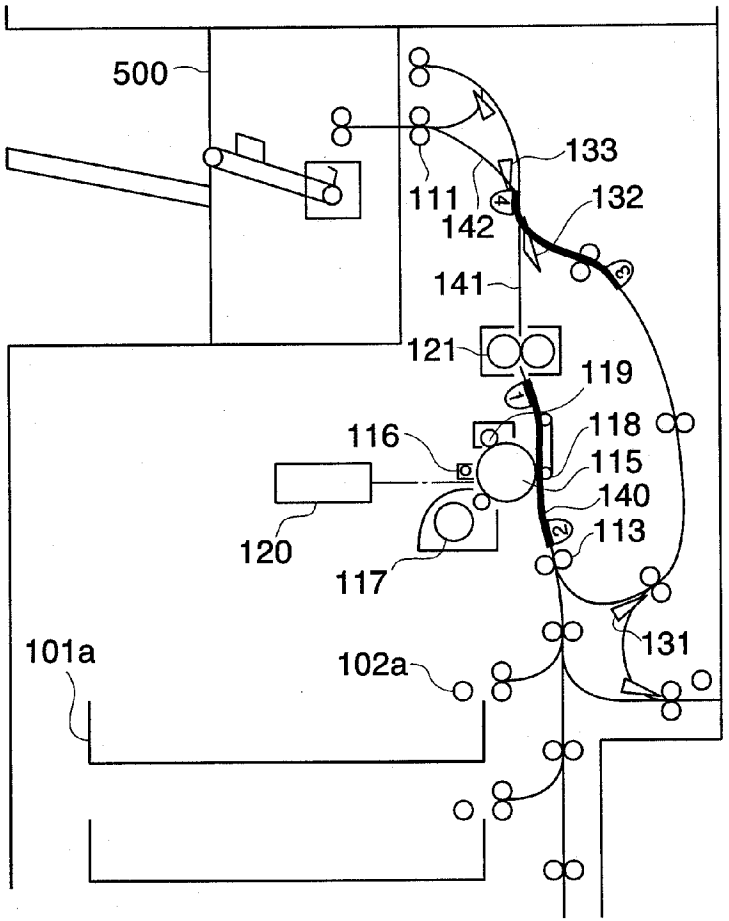
Figure 3C:
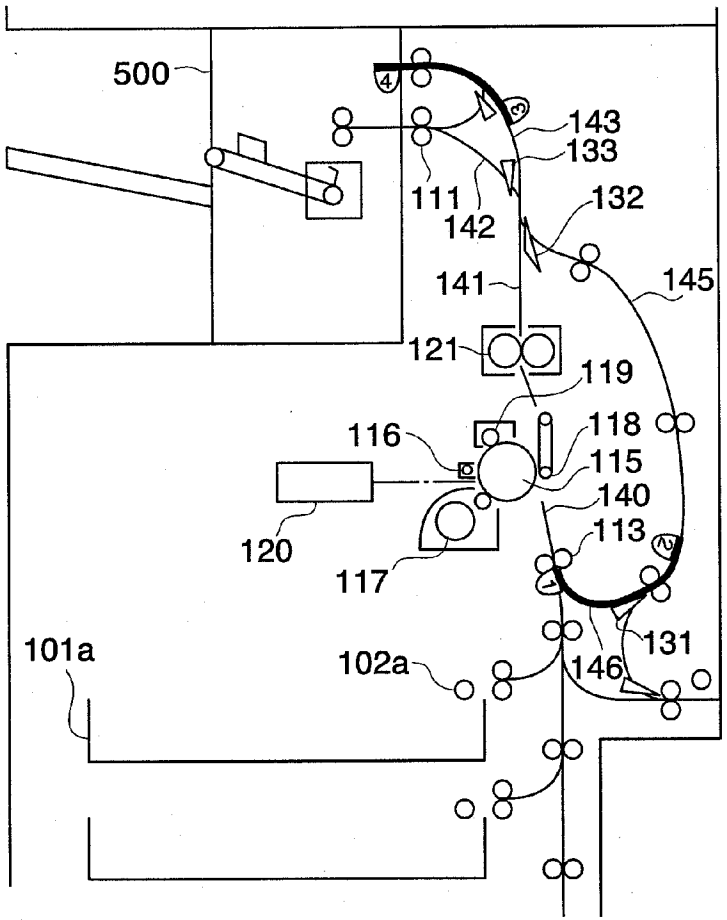

After this, the sheet is fed between the photosensitive drum 115 and the transfer section 118 once again and in the transfer section 118, a developer image formed on the photosensitive drum 115 is transferred onto the other surface (a surface that is a first page) of the fed sheet (see FIG. 3D). The sheet then passes the fixing section 121 and after the image has been formed on the other surface of the sheet, the orientation of the flapper 133 is switched, the sheet is guided from the conveying path 141 to the conveying path 142, and is discharged via the discharge roller 111 from the printer 100 to the external finisher 500 (see FIG. 3E).

At this time, the sheet is discharged with the surface of the sheet on which image formation has been carried out second (the surface that is the first page) facing down. In this way, to make the page order match when the sheet is discharged from the printer 100 to the external finisher 500, image formation is carried out first on the rear surface of the sheet. Note that although in the present embodiment, when double-sided image formation is carried out on a plurality of sheets, image formation is carried out on a plurality of sheets (in this example, two sheets) in parallel, it is also possible to form images on both front and rear surfaces of a sheet before starting image formation on a following sheet.

Figure 3F:
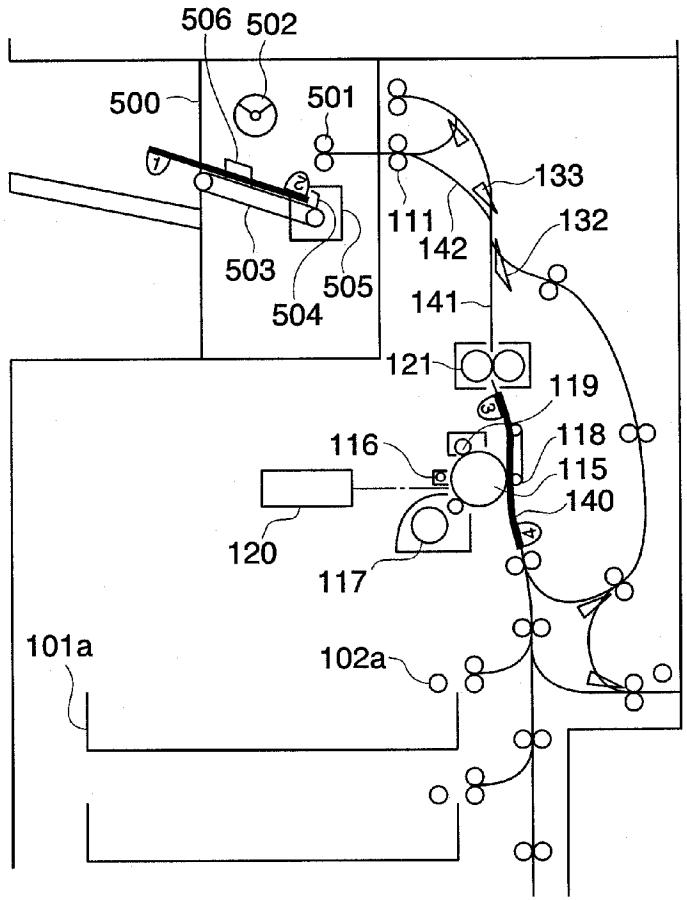
Figure 3E:
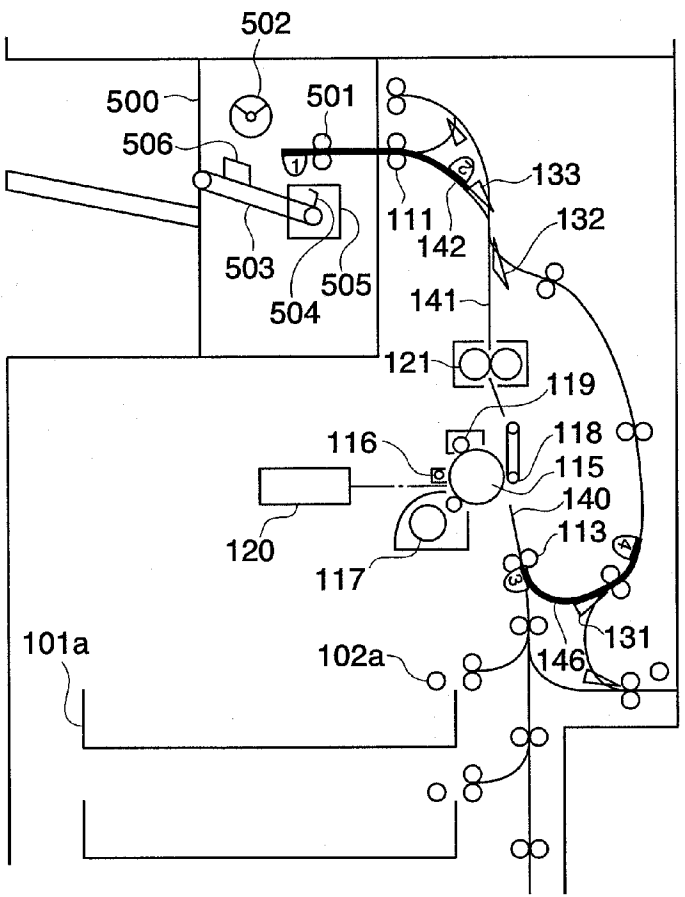
Figure 3G:
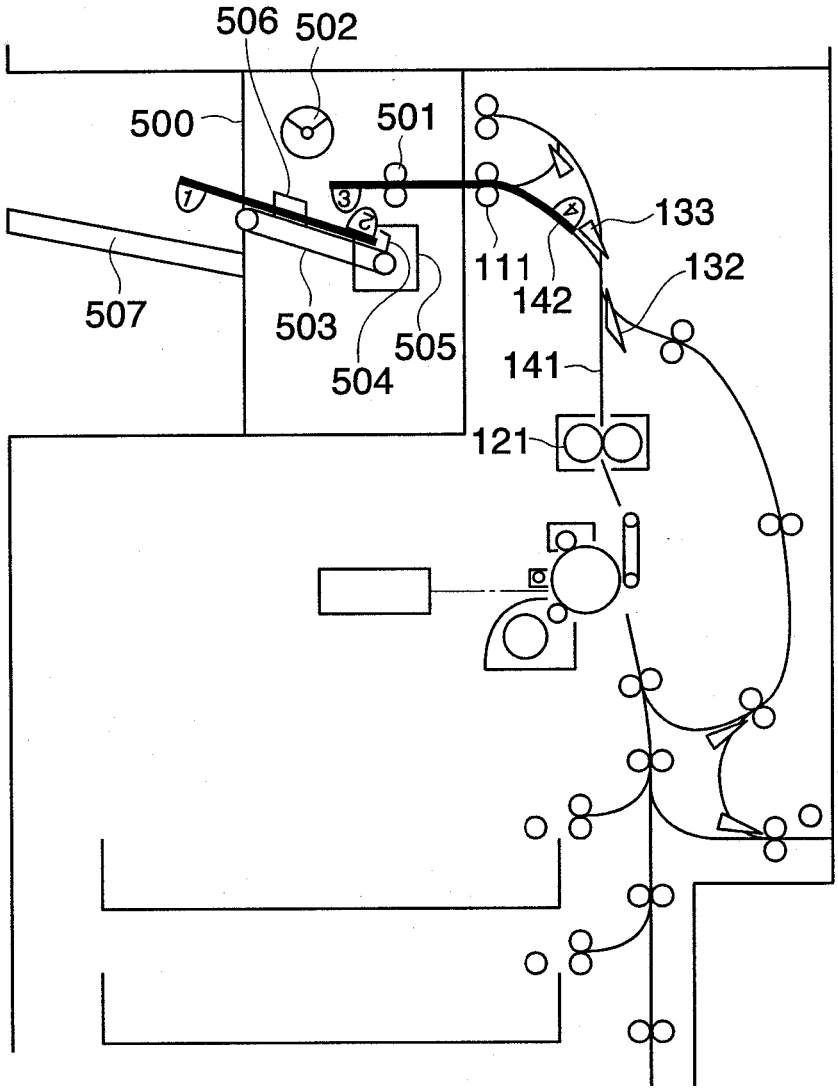

Once the sheet discharged from the printer 100 has been sent to the finisher 500, the sheet is discharged onto a bundle discharge belt 503 by a discharge roller 501 inside the finisher 500 (see FIGS. 3F and 3G). More specifically, an intermediate processing tray, not shown, is disposed in parallel with the bundle discharge belt 503 in a front-rear direction in the figures (a depth direction for the image forming apparatus 10) at a position that is several millimeters higher than the bundle discharge belt 503, and the sheet is discharged onto this intermediate processing tray. The discharged sheet falls due to its own weight in a lower right direction as viewed in the figures along the intermediate processing tray, not shown, which is inclined in the same way as the bundle discharge belt 503 and has low friction, and the bundle discharge belt 503.

In addition, by rotating a fan-shaped return roller 502 anticlockwise in FIG. 3G, a frictional member provided on an arc of a return roller 502 is placed in contact with the sheet to assist the falling of the sheet to the lower right as viewed in FIG. 3G, with the end of the sheet abutting a stopper plate 504. By doing so, an aligning operation is carried out for ends of sheets in the vertical direction (feeding direction).

Aligning plates 506 are provided at near and far positions in the depth direction as viewed in FIG. 3G (in the front-rear direction for the image forming apparatus) on the intermediate processing tray (not shown), and by driving the aligning plates 506 whenever a sheet is discharged onto the intermediate processing tray, an operation that aligns ends of the sheets discharged onto the intermediate processing tray in the width or transverse direction is carried out.

Figure 4:
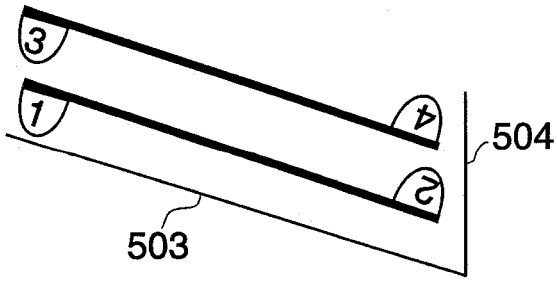
FIG. 4 is a diagram showing a stacking state of sheets discharged onto an intermediate processing tray in the double-sided mode.

FIG. 4 is a diagram showing a stacking state of sheets discharged onto the intermediate processing tray in the double-sided mode. When a predetermined number of sheets have been discharged and stacked onto the intermediate processing tray, the bundle discharge belt 503 is driven and the stacked sheet bundle is discharged onto a stack tray 507. When execution of a stapling process has been set, a bundle of sheets to be stapled is discharged onto the intermediate processing tray and an end aligning operation is carried out for the sheets by the aligning plates 506. After this, a stapler 505 is driven to carry out a stapling operation, and the stapled sheet bundle is discharged onto the stack tray 507 by the bundle discharge belt 503. The stapler 505 is freely movable in the width direction relative to the sheet bundle on the intermediate processing tray and therefore can carry out the stapling operation at a desired position in the depth direction in FIG. 4 (in the front-rear direction for the image forming apparatus 10).

Figure 5:
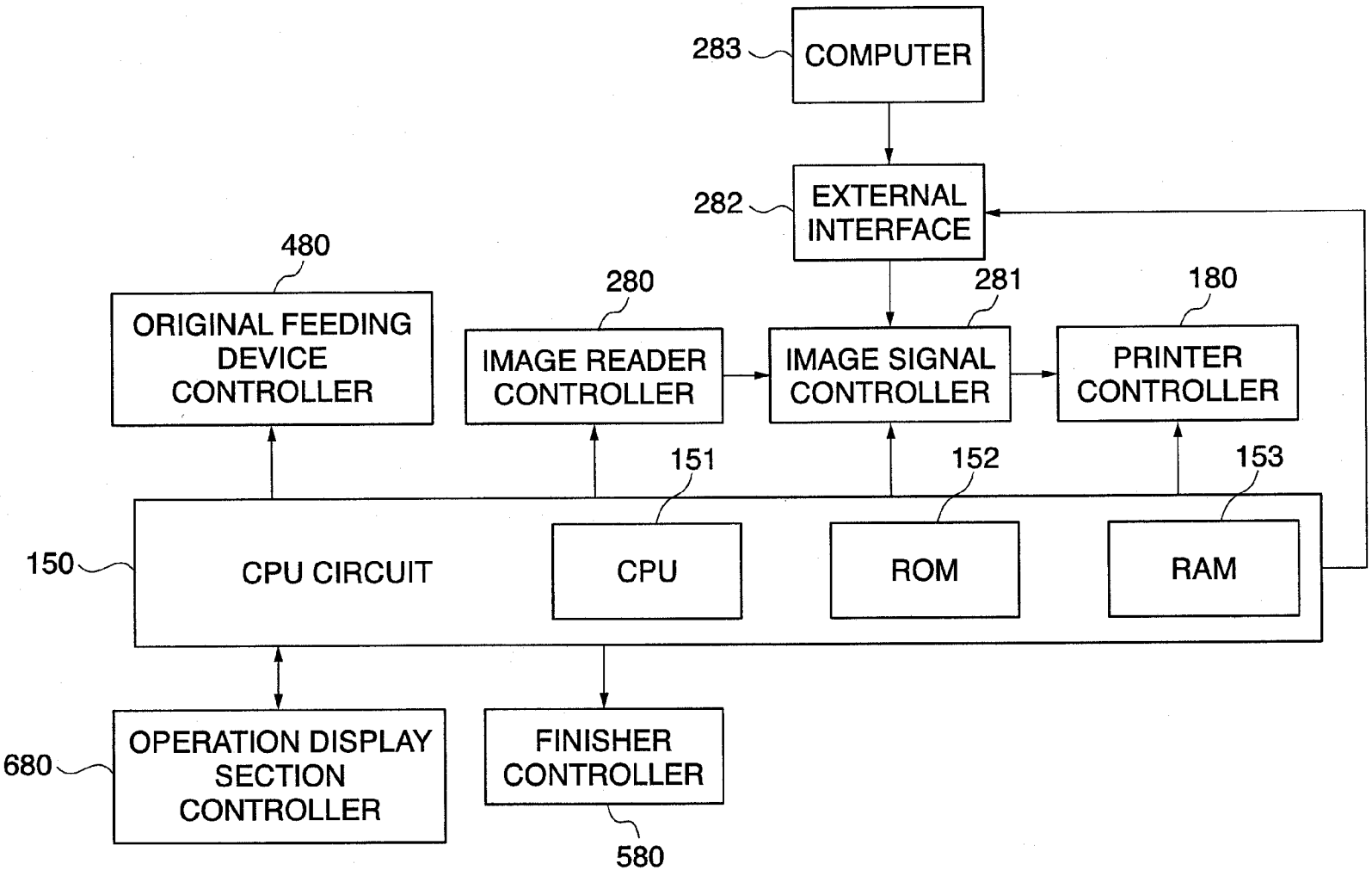
FIG. 5 is a block diagram showing the construction of a controller of the image forming apparatus.

FIG. 5 is a block diagram showing the construction of a controller that controls the entire image forming apparatus. The controller includes a CPU circuit 150, an original feeding device controller 480, an image reader controller 280, an image signal controller 281, a printer controller 180, an operation display section controller 680, and a finisher controller 580. The image signal controller 281 is connected to an external computer 283 via an external interface (I/F) 282.

The CPU circuit 150 includes a CPU 151, a ROM 152, and a RAM 153 and carries out overall control of the respective parts of the image forming apparatus 10 by having the CPU 151 execute control programs stored in the ROM 152. The RAM 153 temporarily stores control data and is used as a work area for computational processes when the CPU 151 executes the control programs.

The original feeding device controller 480 controls the original feeding device 400 in accordance with an instruction from the CPU circuit 150. The image reader controller 280 controls the scanner unit 202, the image sensor 203, and the like to transfer an analog image signal outputted from the image sensor 203 to the image signal controller 281.

The image signal controller 281 converts the analog image signal from the image sensor 203 to a digital signal, then carries out various processes on the digital signal, converts the processed digital signal to a video signal, and outputs the video signal to the printer controller 180. Further, the image signal controller 281 carries out various processes on a digital image signal inputted from the computer 283 via the external I/F 282, converts the processed digital image signal to a video signal, and outputs the video signal to the printer controller 180. The operation of the image signal controller 281 is controlled by the CPU circuit 150.

The operation display section controller 680 exchanges information between an operation display section 600 (see FIG. 6) and the CPU circuit 150. As described later, the operation display section 600 includes a plurality of keys for setting various functions relating to image formation, a display section for displaying setting states, and the like, outputs key signals corresponding to operations of the respective keys to the CPU circuit 150, and displays corresponding information based on signals from the CPU circuit 150 on the display section. The printer controller 180 drives the exposure controller 120 based on the inputted video signal.

Figure 6:
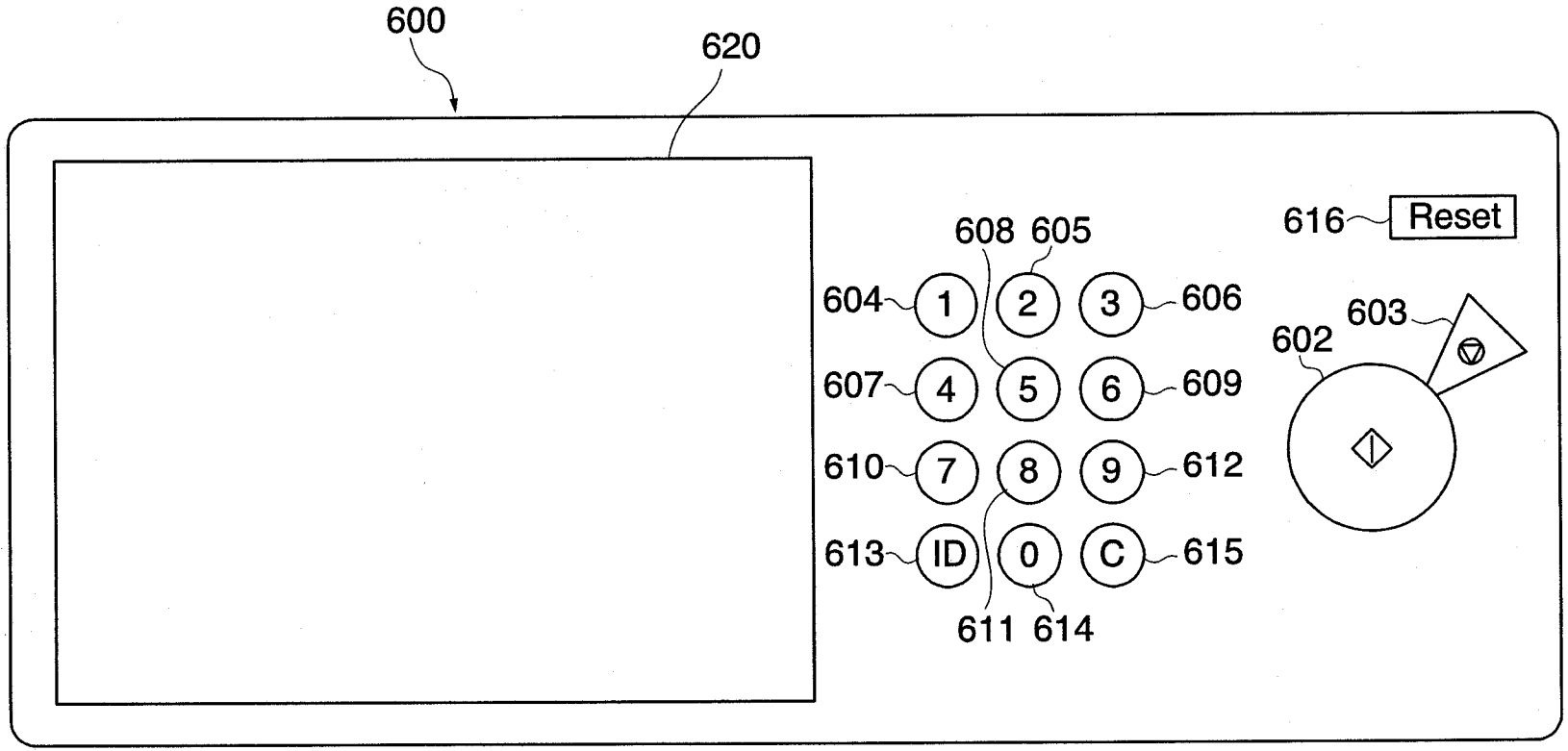
FIG. 6 is a view showing the appearance of an operation display section in the image forming apparatus.

FIG. 6 is a view showing the appearance of the operation display section 600 in the image forming apparatus. A start key 602 that starts an image forming operation, a stop key 603 that suspends the image forming operation, a ten key 604 to 612, 614 used to set numerical values (for example, the number of copies) and the like, an ID key 613, a clear key 615, a reset key 616, and the like are disposed in this operation display section 600.

A liquid crystal display section 620, on which a touch panel is formed, is disposed on an upper part of the operation display section 600, with soft keys being provided on the screen thereof. For example, the image forming apparatus 10 according to the present embodiment has various processing modes such as "non-sort" (group), "sort", and "staple-sort" (binding mode) as post-processing modes of the finisher 500. These processing modes are set by input operations made using the operation display section 600. A setting of a mode that inserts a front cover/rear cover/interleaved sheet is also made via the touch panel.

Figure 7A:
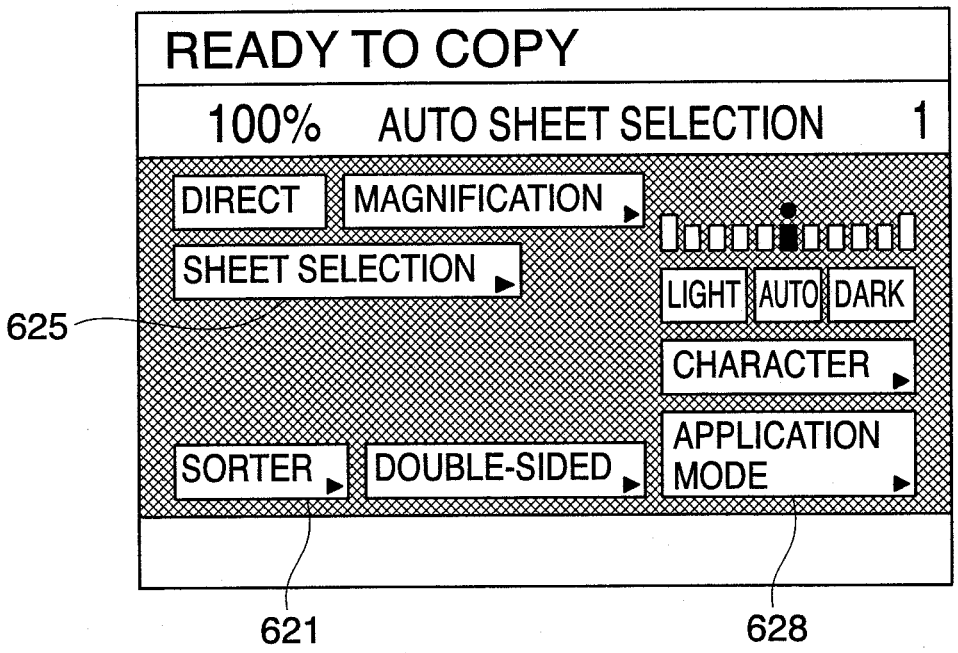
FIGS. 7A and 7B are views showing soft keys displayed on a display section of the operation display section shown in FIG. 6.
Figure 7B:
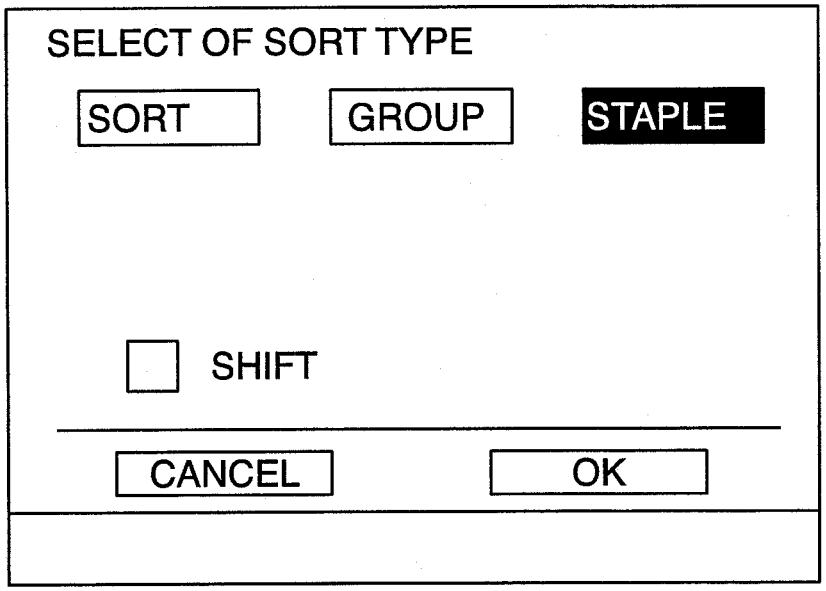

FIGS. 7A and 7B are views showing soft keys displayed on the display section 620. In an initial screen of the display section 620 shown in FIG. 7A, when a "sorter" key 621, which is a soft key, is selected, a menu selection screen shown in FIG. 7B is displayed on the display section 620 and a setting of a processing mode is made via this menu selection screen.

Figure 8A:
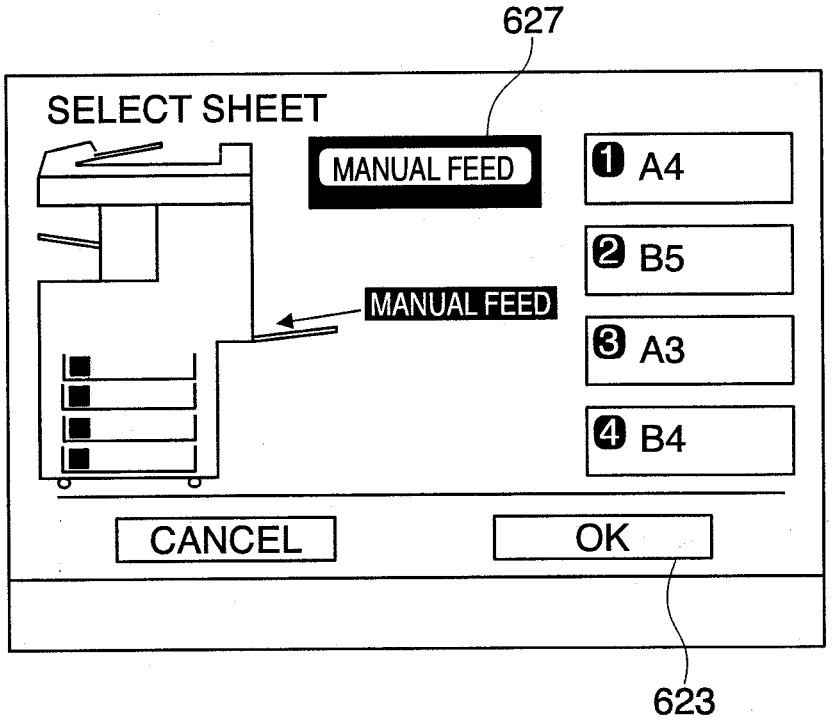
FIGS. 8A and 8B are views showing a setting key for manual feeding mode displayed on the display section and a display state thereof.
Figure 8B:
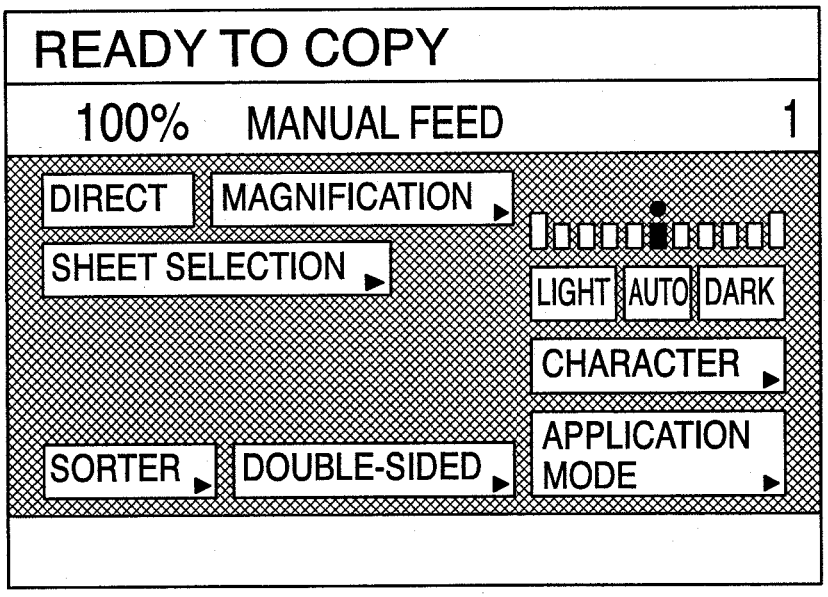
Figure 9A:
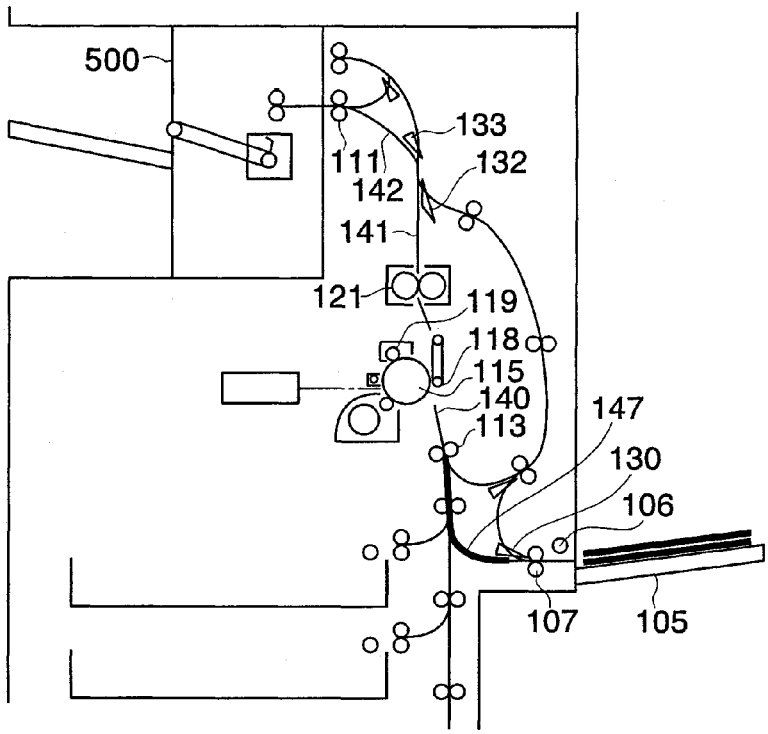
FIGS. 9A and 9B are diagrams showing a sheet conveying operation in the manual feeding mode in the image forming apparatus.
Figure 9B:
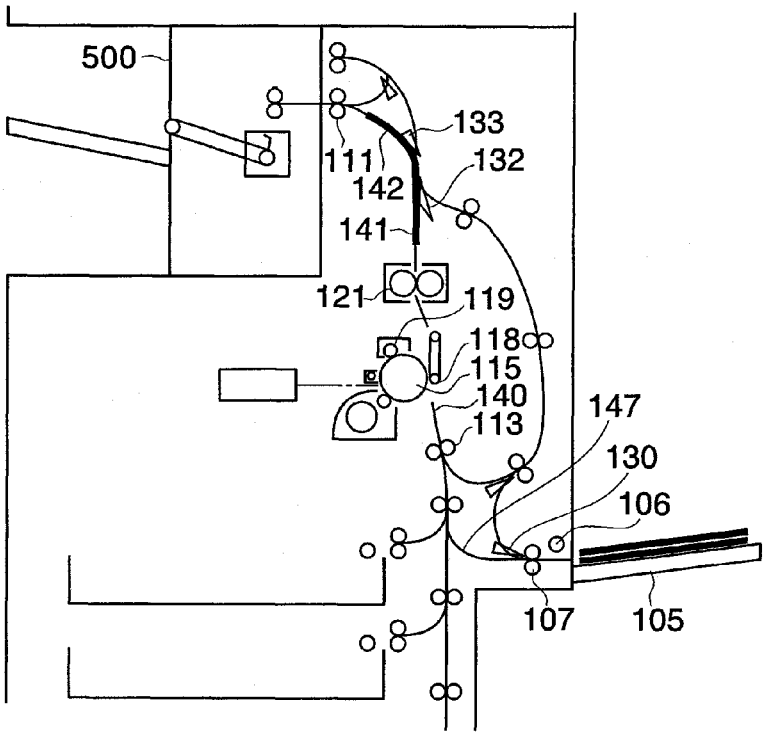

Next, a manual feeding mode in which image formation is carried out on a sheet fed from the manual feed tray 105 will be described. FIGS. 8A and 8B are views showing a setting key for manual feeding mode displayed on the display section 620 and a display state thereof. FIGS. 9A and 9B are diagrams showing how a sheet is conveyed in the manual feeding mode in the image forming apparatus 10.

When image formation is to be carried out on a sheet set on the manual feed tray 105, when a "sheet selection" key 625, which is a soft key, is selected in the initial screen shown in FIG. 7A, the display screen of the display section 620 switches to a sheet selection screen shown in FIG. 8A. In this sheet selection screen, sheet sizes and the like set in the cassettes 101*a* to 101*d* and the manual feed tray 105 are displayed. If a "manual feed" key 627 is selected and an "OK" key 623 is pressed in this state, the display screen returns to the initial screen shown in FIG. 8B, so that an indication that the manual feed tray 105 is selected is displayed on the display section 620.

When the start key 602 is pressed after numerical values and the like have been set using the ten key 604 to 612, 614, the image forming apparatus 10 starts an image forming operation. When a manual feeding roller 106 is brought into contact with an upper surface of a sheet bundle placed on the manual feed tray 105 to start conveying sheets into the printer 100 from an uppermost sheet in the sheet bundle, the uppermost sheet is separated from the sheet bundle and conveyed by a pair of manual feed separation rollers 107. A flapper 130 is provided downstream of the pair of manual feed separation rollers 107, and as shown in FIG. 9A, the sheet is guided to the conveying path 147 and is conveyed until the leading edge abuts the registration roller 113.

After this, as shown in FIG. 9B, in the same way as in the image forming operation shown in FIG. 2, the sheet is conveyed from the transfer section 118 to the fixing section 121, is guided to the conveying path 142 by the flapper 133, and is discharged via the discharge roller 111 from the printer 100 to the external finisher 500.

Next, the "front cover mode/interleaving mode/rear cover mode" of the image forming apparatus 10 will be described. FIGS. 10A to 10E are views showing setting keys for "front cover mode/interleaving mode/rear cover mode" displayed by the display section 620 and display states thereof. When an "application mode" key 628, which is a soft key, is selected in the initial screen shown in FIG. 7A, the display screen of the display section 620 is switched to a display screen shown in FIG. 10A where various modes are selected. Here, when a "front cover/interleaving/rear cover" key 635 is selected, the display screen switches to a screen shown in FIG. 10B where "front cover mode", "interleaving mode" or "rear cover mode" can be selected.

Figure 10A:
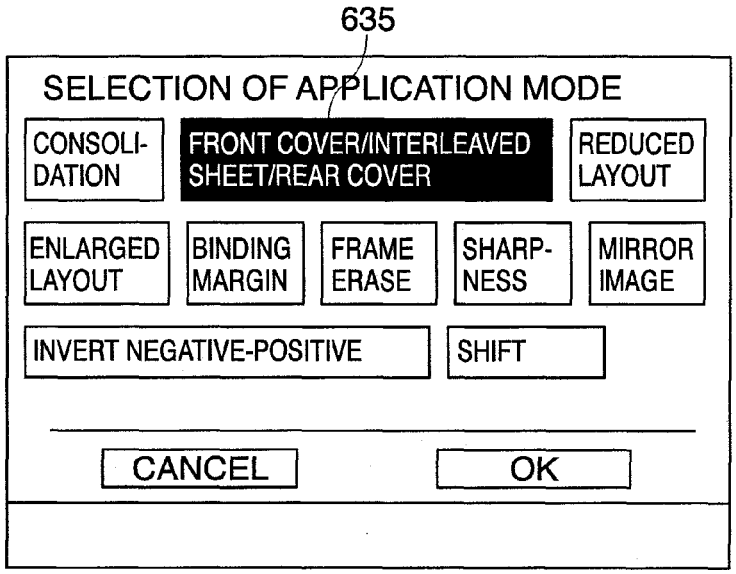
FIGS. 10A to 10E are views showing setting keys for "front cover mode/interleaving mode/rear cover mode" displayed by the display section and display states thereof.
Figure 10B:
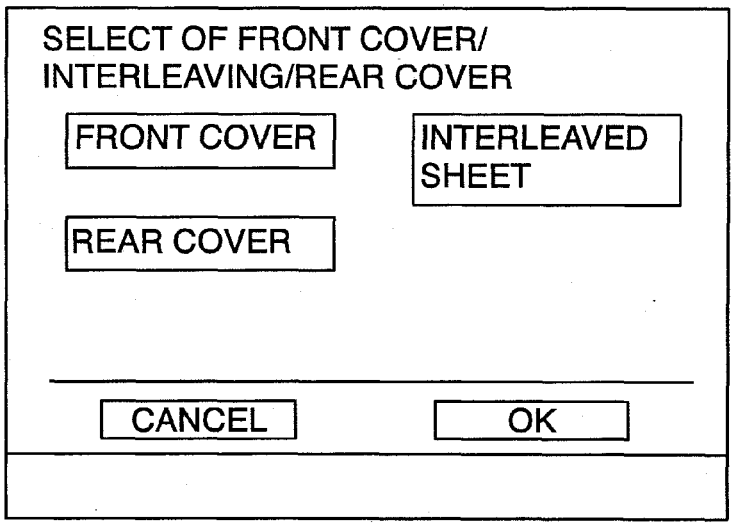
Figure 10C:
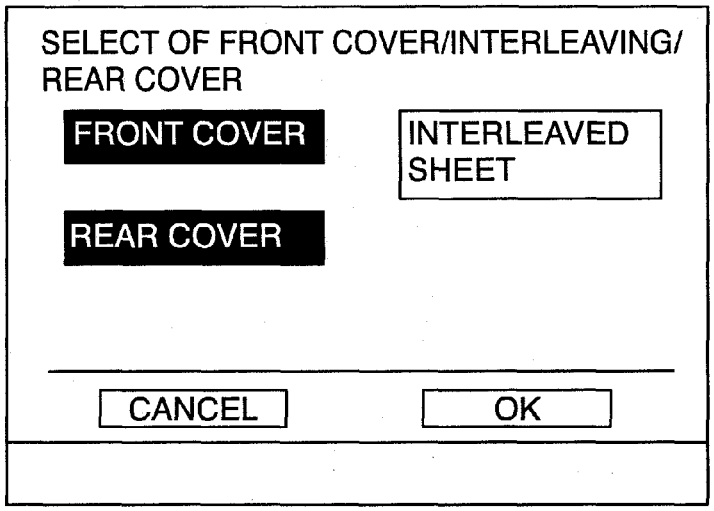
Figure 10E:
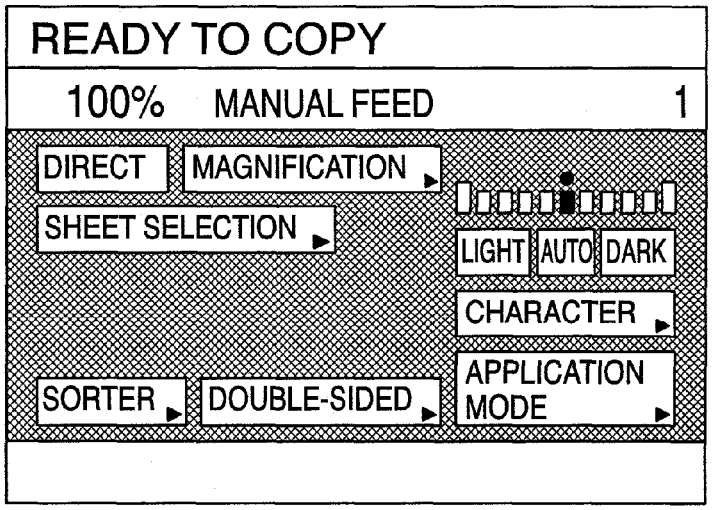
Figure 11A:
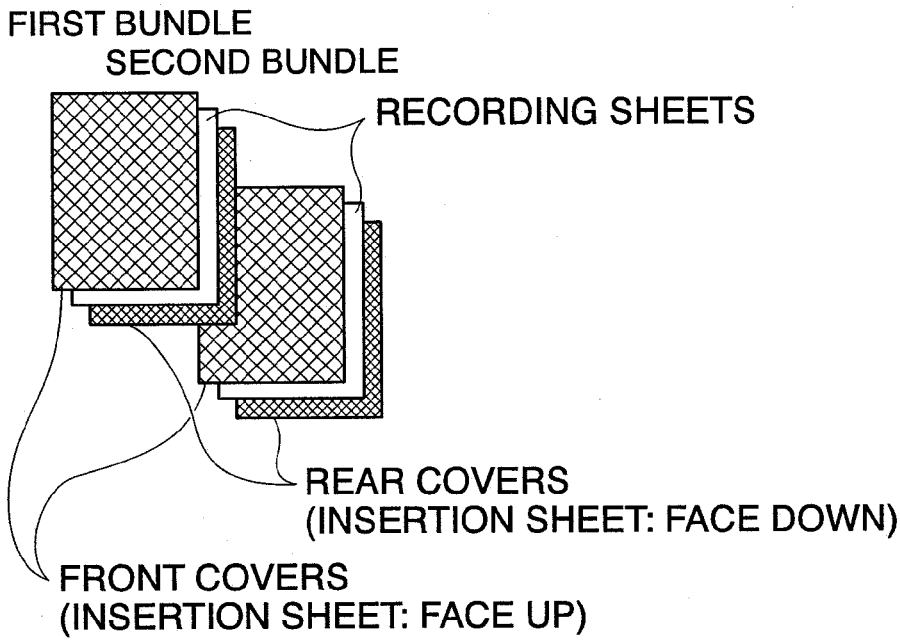
FIGS. 11A and 11B are diagrams useful in explaining "front cover mode", "interleaving mode" and "rear cover mode"
Figure 11B:
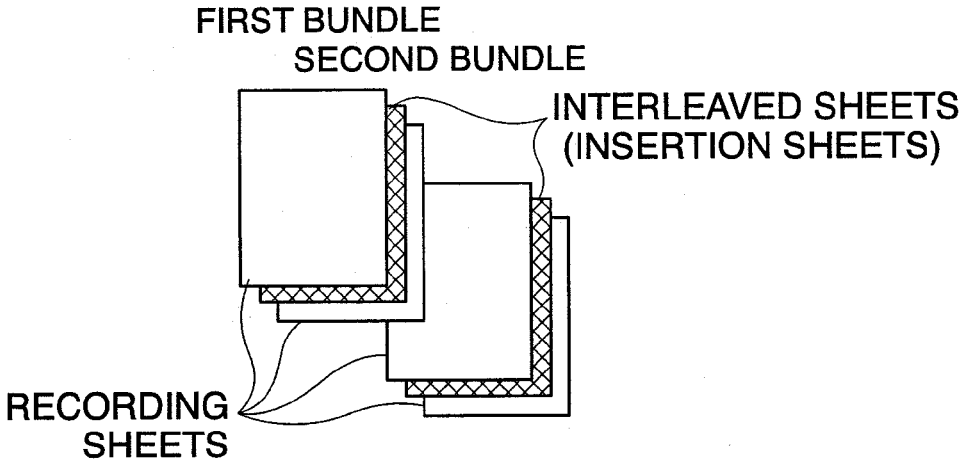
Figure 12A:
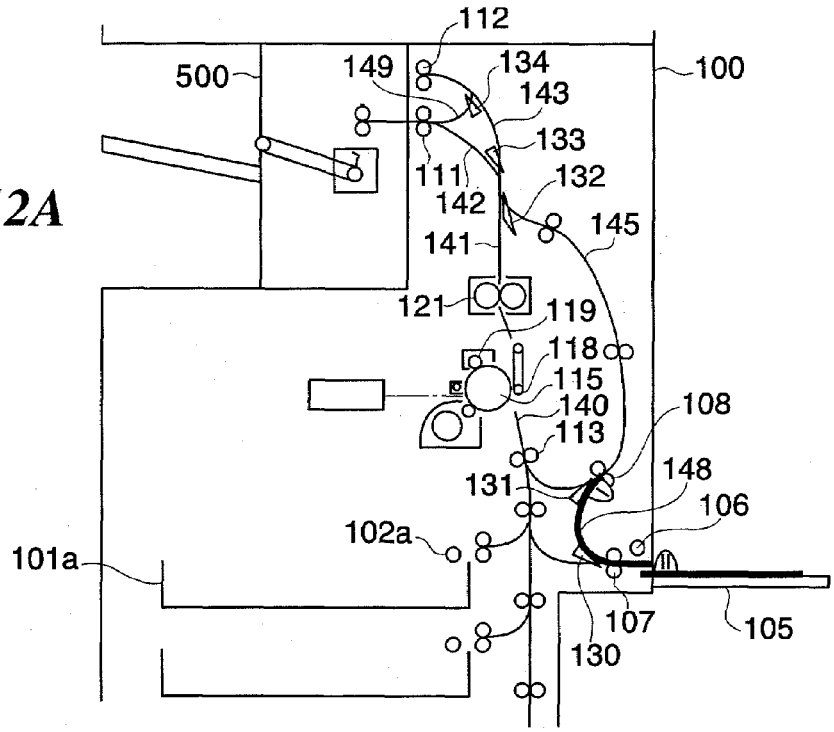
FIGS. 12A to 12I are diagrams showing a sheet conveying operation in "mode I" of the image forming apparatus.
Figure 12B:
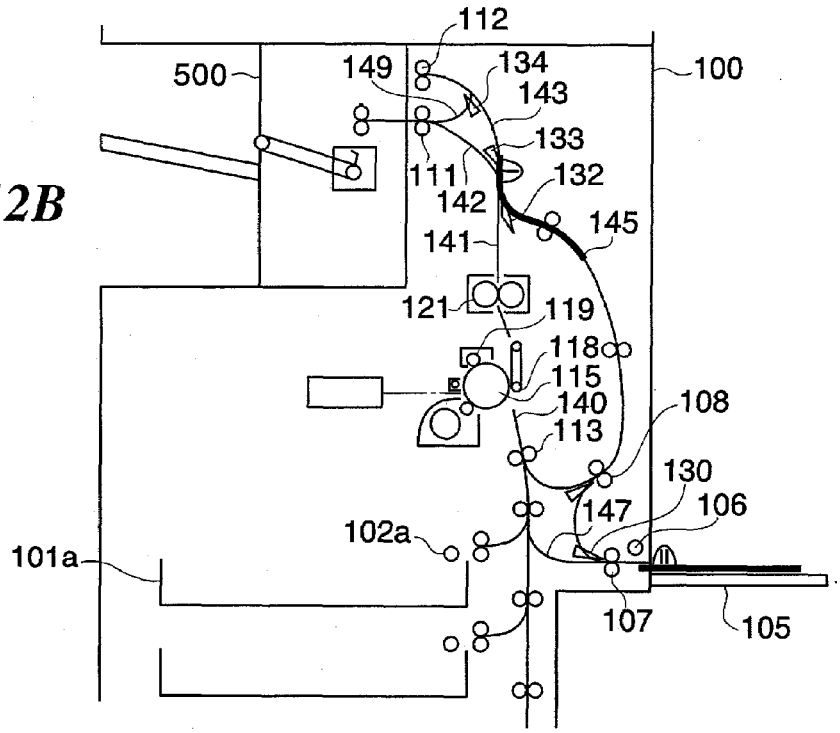
Figure 12C:
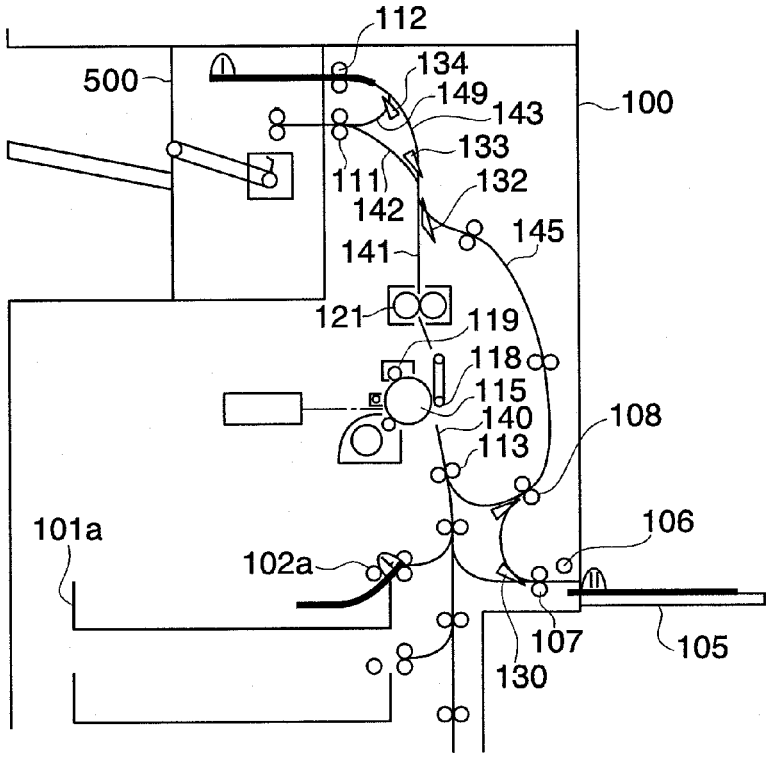
Figure 12D:
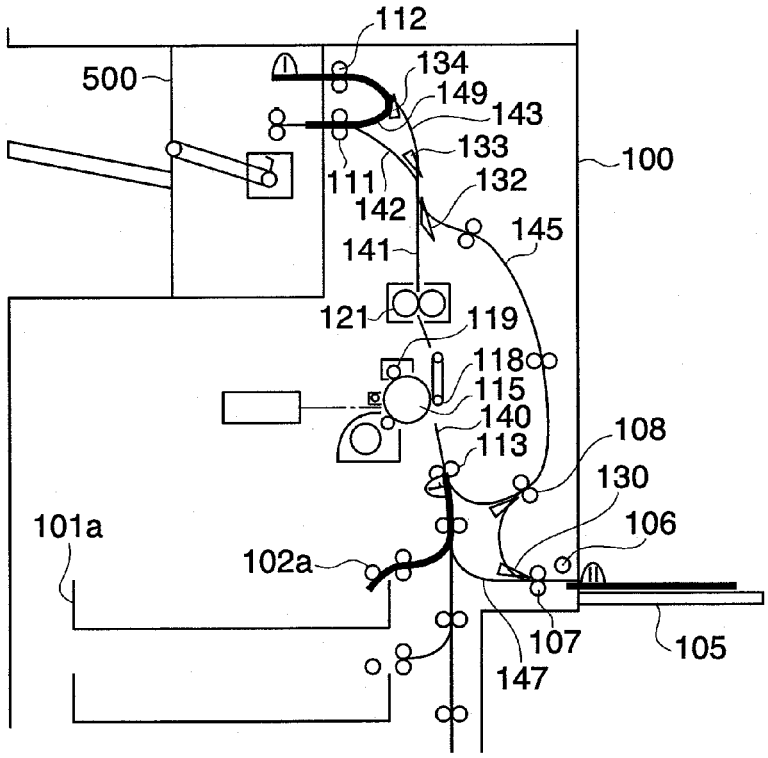
Figure 12E:
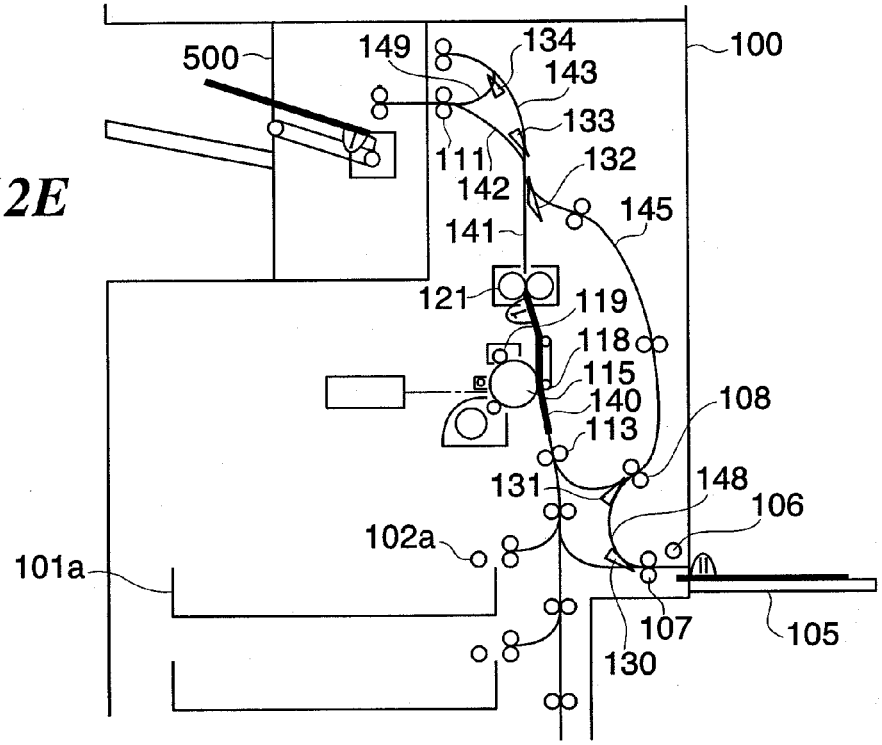
Figure 12F:
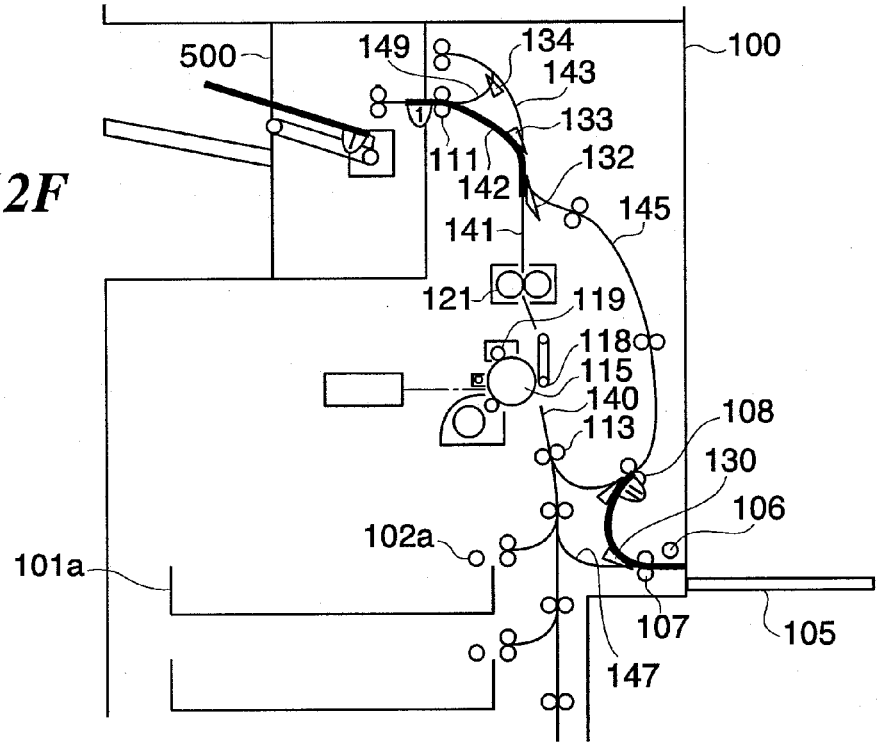
Figure 12G:
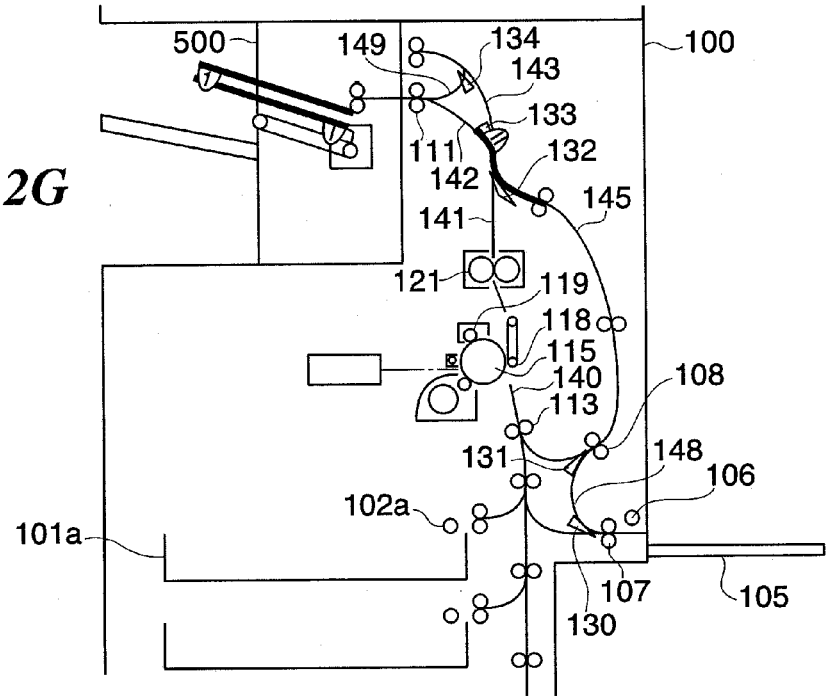
Figure 12H:
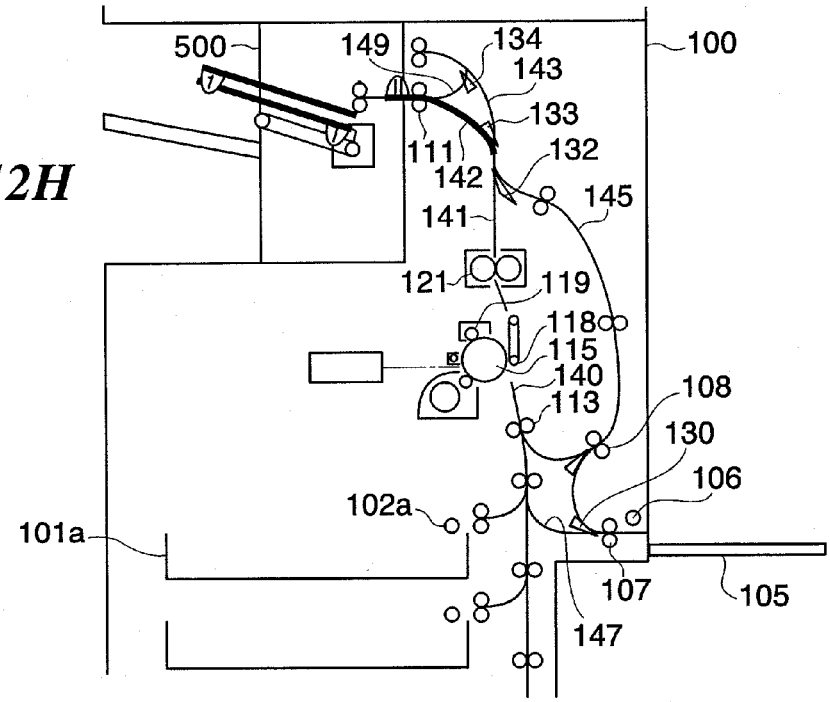
Figure 12I:
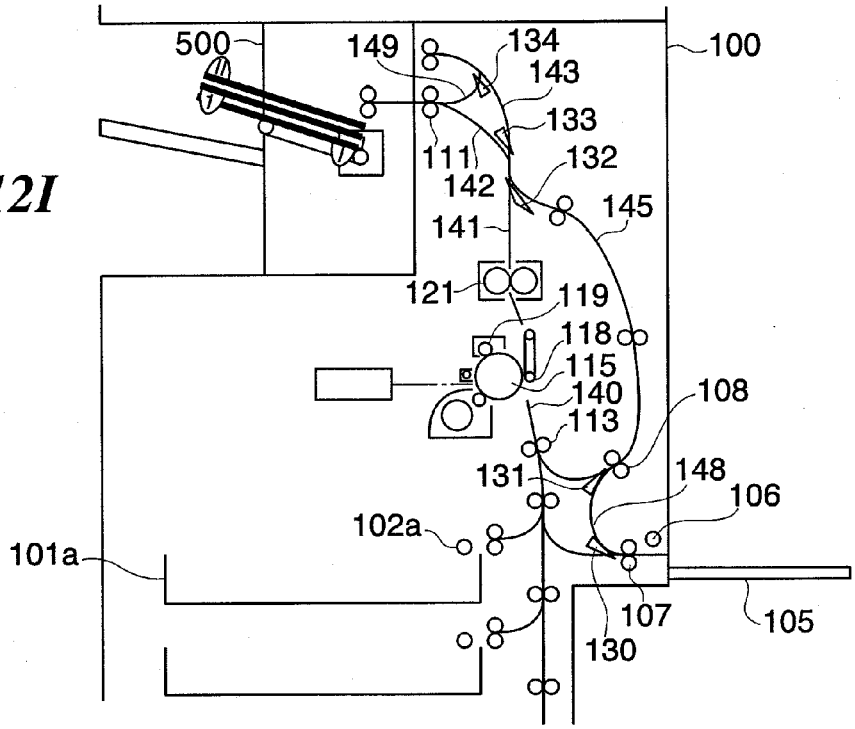

FIGS. 11A and 11B are diagrams useful in explaining "front cover mode", "interleaving mode" and "rear cover mode". As shown in FIG. 11A, in "front cover mode", a designated sheet is inserted into a sheet bundle for each copy to be made at the front page thereof. On the other hand, as shown in FIG. 11B, in "interleaving mode", a designated sheet is inserted into a sheet bundle for each copy to be made at a desired page thereof. For example, "interleaving mode" is set when inserting color printout sheets into a bundle of recording sheets outputted from a black and white image forming apparatus. As shown in FIG. 10C, when "front cover mode" or "rear cover mode" has been selected in the screen shown in FIG. 10B, the display screen of the display section 620 returns to the initial screen (see FIG. 10E).

Figure 10D:
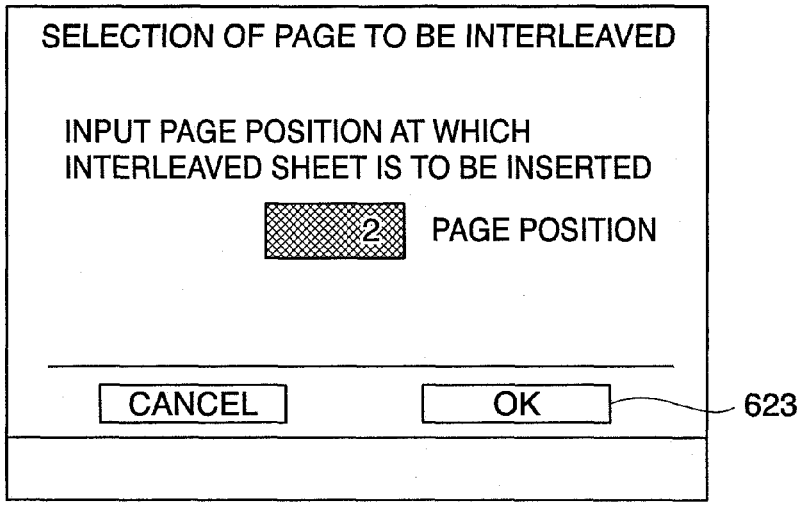

On the other hand, when the interleaving mode is selected in the screen shown in FIG. 10B, the display screen of the display section 620 switches to an interleaved page selection screen shown in FIG. 10D to set the number of the page in the sheet bundle at which a sheet is to be inserted. In the interleaved page selection screen, the inserted page number is inputted by pressing the ten key 604 to 612, and/or 614 and when the "OK" key 623 is pressed after such input, the display screen returns to the initial screen (see FIG. 10E). In the present embodiment, in any of "front cover mode", "interleaving mode" and "rear cover mode", a sheet set on the manual feed tray 105 is fed as a sheet to be inserted, so that as shown in FIG. 10E, a state where the manual feed tray 105 is selected is displayed on the display section 620.

Figure 13:
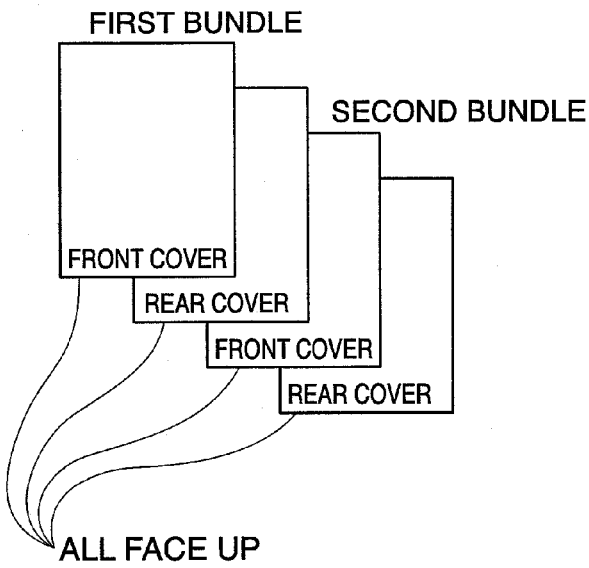
FIG. 13 is a diagram showing insertion sheets for the front cover and rear cover that are placed face up on a manual feed tray.

FIGS. 12A to 12I are diagrams showing a sheet conveying operation in "mode I" of the image forming apparatus 10. In the sheet conveying operation in "mode I", to produce a sheet bundle, image formation is carried out on one sheet fed from the cassette 101*a*, a front cover is inserted into the sheet bundle at the first page thereof, and a rear cover is inserted at the third page, and therefore insertion sheets for the front cover and the rear cover are placed face-up on the manual feed tray 105. FIG. 13 is a diagram showing insertion sheets for the front cover and rear cover that are placed face up on the manual feed tray 105. In FIGS. 12A to 12I, "I" and "II" designate the numbers of the insertion sheets being fed. It should be noted that when "mode I" is selected, an indication that instructs the user to place the insertion sheets for the front cover and the rear cover face up is displayed on the operation display section 600.

The insertion sheet (I) inserted at the first page as the front cover is conveyed by the manual feeding roller 106 and the pair of manual feed separation rollers 107 into the printer 100 and is guided to a conveying path 148 by the flapper 130. The insertion sheet (I) is conveyed until a leading edge thereof abuts a pair of double-sided conveying rollers (interleaving registration rollers) 108. In the same way as the registration roller 113, the pair of double-sided conveying rollers 108 corrects any skewing of the insertion sheet (I) fed from the manual feed tray 105. After this, the insertion sheet (I) is guided to the conveying path 143 by flappers 132, 133, and 134 (see FIG. 12B), and when a trailing end of the insertion sheet (I) has passed the flapper 134, the sheet stops in a state where the sheet is nipped by the inverting rollers 112 (see FIG. 12C). When the orientation of the flapper 134 is switched and the inverting rollers 112 are driven in reverse, the insertion sheet (I) is guided from the conveying path 143 to an inverting path 149 and is then conveyed via the discharge roller 111 from the printer 100 to the finisher 500 in a face-down state (see FIG. 12D).

At the same time as the insertion sheet (I) is conveyed to the finisher 500, a sheet fed from the cassette 101*a* by a feeding roller 102*a* is conveyed to the registration roller 113 and is then conveyed from the transfer section 118 to the fixing section 121 and guided to the conveying path 142 by the flapper 133 (see FIGS. 12C to 12F). After this, the sheet on which an image has been formed is discharged via the discharge roller 111 from the printer 100 to the finisher 500 in a face-down state (see FIG. 12G).

The insertion sheet (II), i.e., a sheet for the third page that is the rear cover, is conveyed into the printer 100 by the manual feeding roller 106 and the manual feed separation rollers 107, and is guided to the conveying path 148 by the flapper 130. After this, the sheet is conveyed until a leading edge thereof abuts the pair of double-sided conveying rollers (interleaving registration rollers) 108 (see FIG. 12F). As described above, in the same way as the registration roller 113, the double-sided conveying rollers 108 correct any skewing of the insertion sheet (II) fed from the manual feed tray 105. After this, the insertion sheet (II) is guided via the double-sided conveying path 145 by the flappers 132, 133 to the conveying path 142 (see FIGS. 12G, 12H), and is discharged via the discharge roller 111 from the printer 100 to the finisher 500 in a face-up state (see FIG. 12I).

FIGS. 14A to 14I are diagrams showing a sheet conveying operation in "mode II" of the image forming apparatus 10. In the sheet conveying operation in "mode II", priority is placed on productivity, and to produce a sheet bundle, image formation is carried out on one sheet fed from the cassette 101*a*, a front cover is inserted into the sheet bundle at the first page thereof and a rear cover is inserted at the third page, and therefore insertion sheets for the front cover are placed face-down and insertion sheets for the rear cover are placed face-up on the manual feed tray 105. FIG. 15 is a diagram showing insertion sheets for the front cover that are placed face-down on the manual feed tray 105 and insertion sheets for the rear cover that are placed face-up. It should be noted that when "mode II" is selected, an indication instructing the user to place the insertion sheets for the front cover face down on the manual feed tray 105 and the insertion sheets for the rear cover face up on the manual feed tray 105 is displayed on the operation display section 600. Mode I and mode II are selected using the operation display section 600.

Figure 14A:
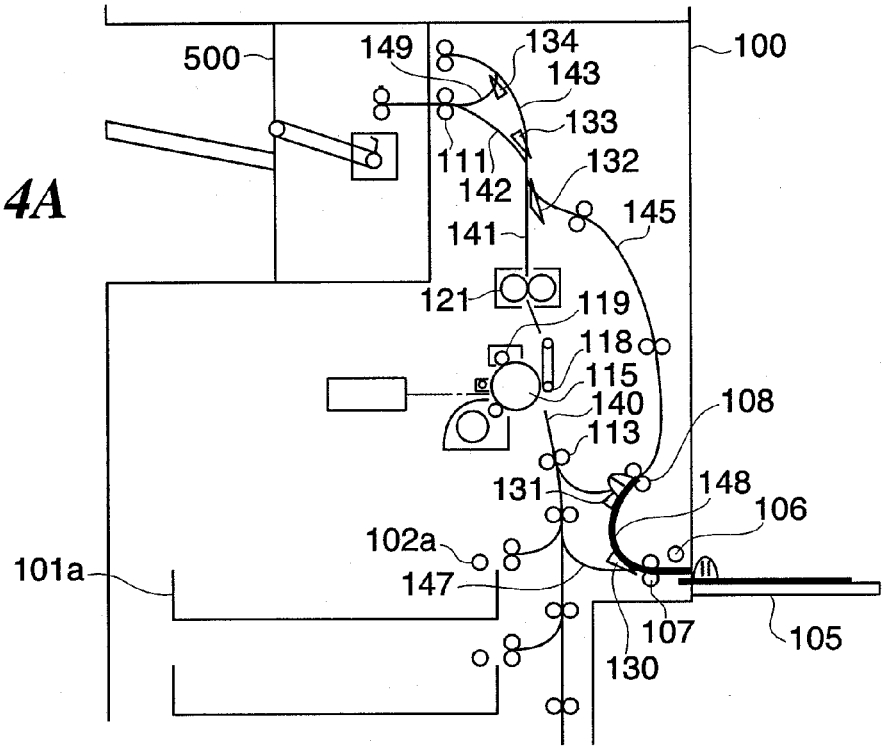
FIGS. 14A to 14I are diagrams showing a sheet conveying operation in "mode II" of the image forming apparatus.
Figure 14B:
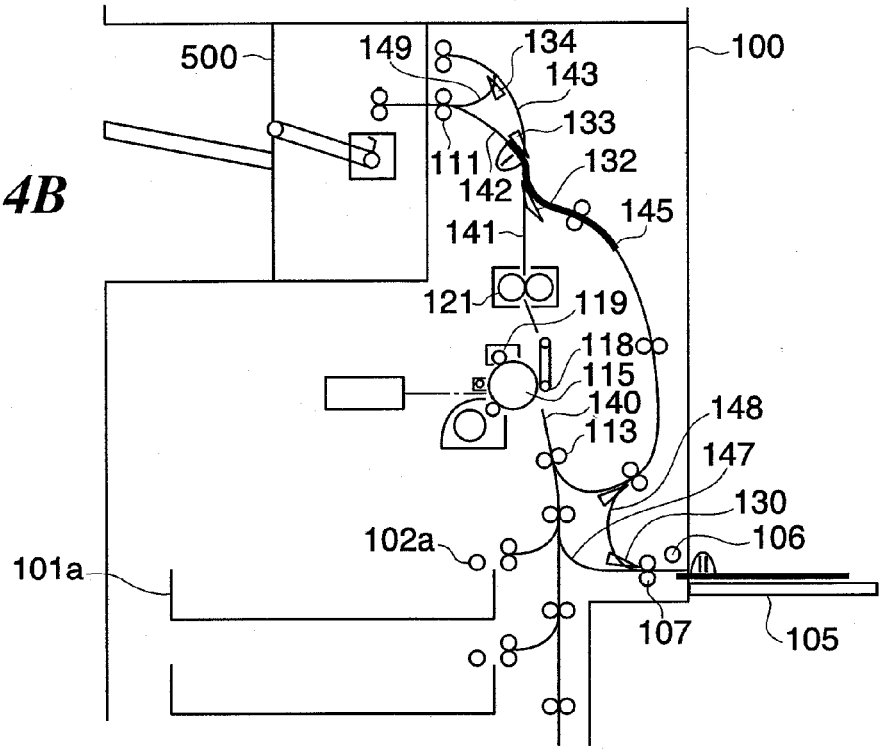
Figure 14C:
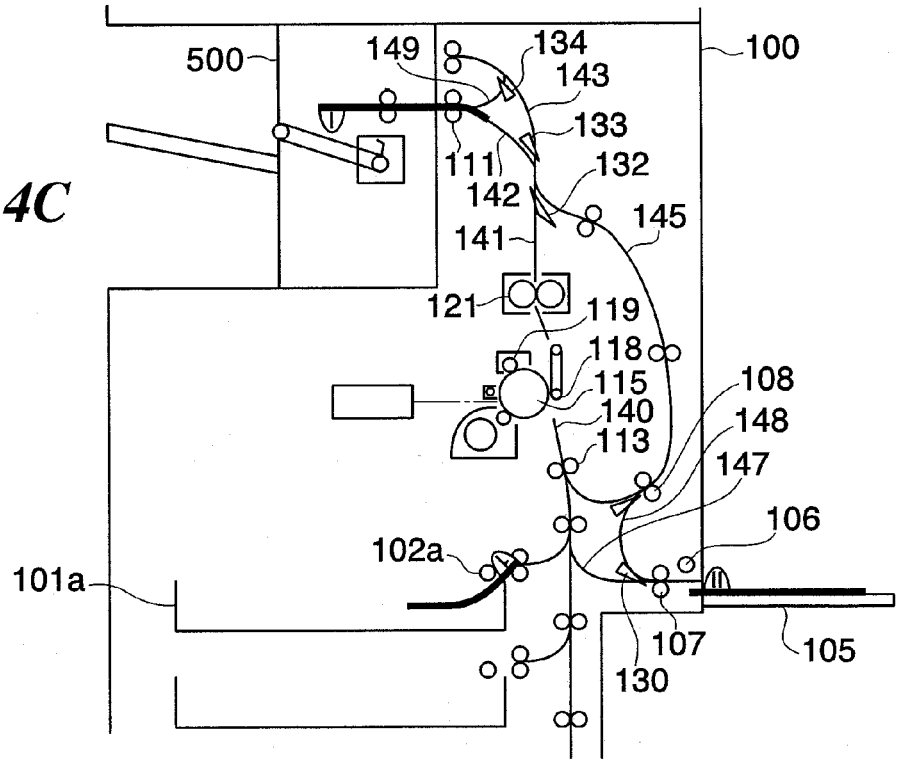
Figure 14D:
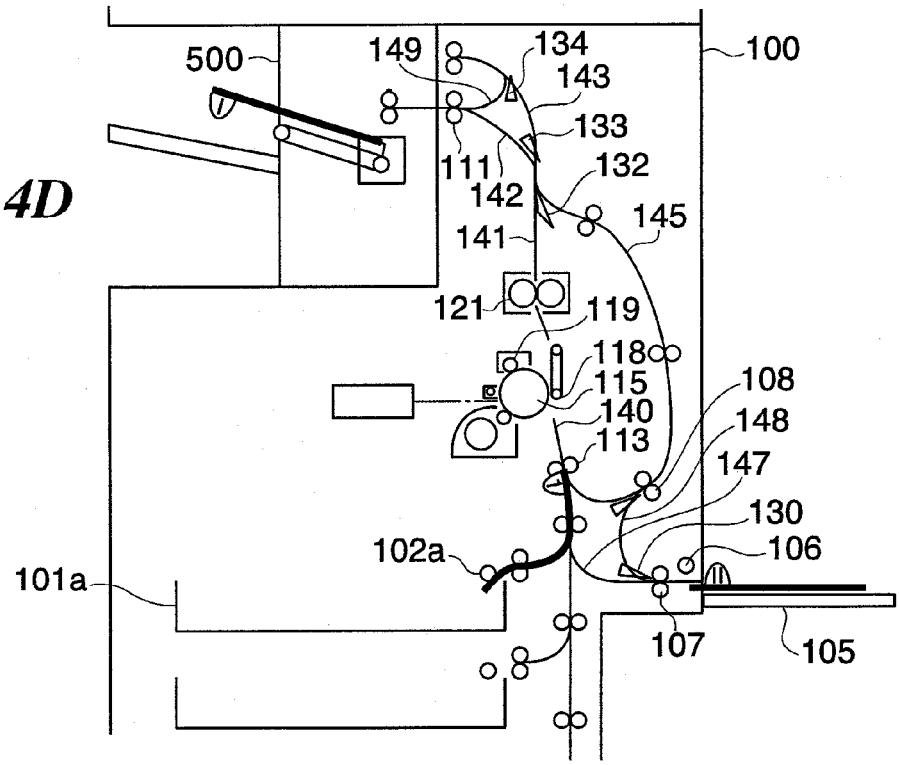
Figure 14E:
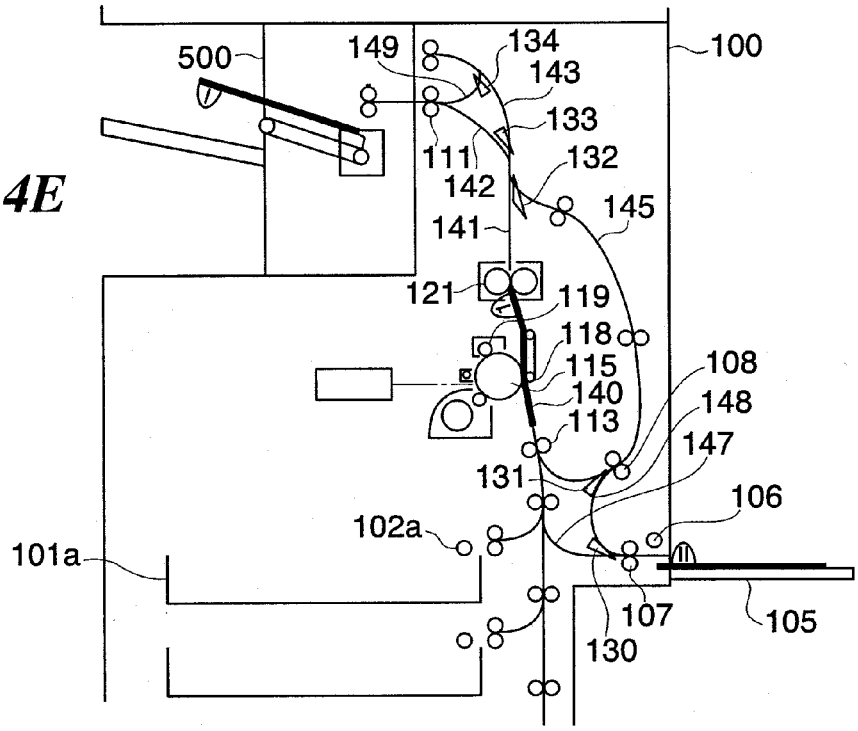
Figure 14F:
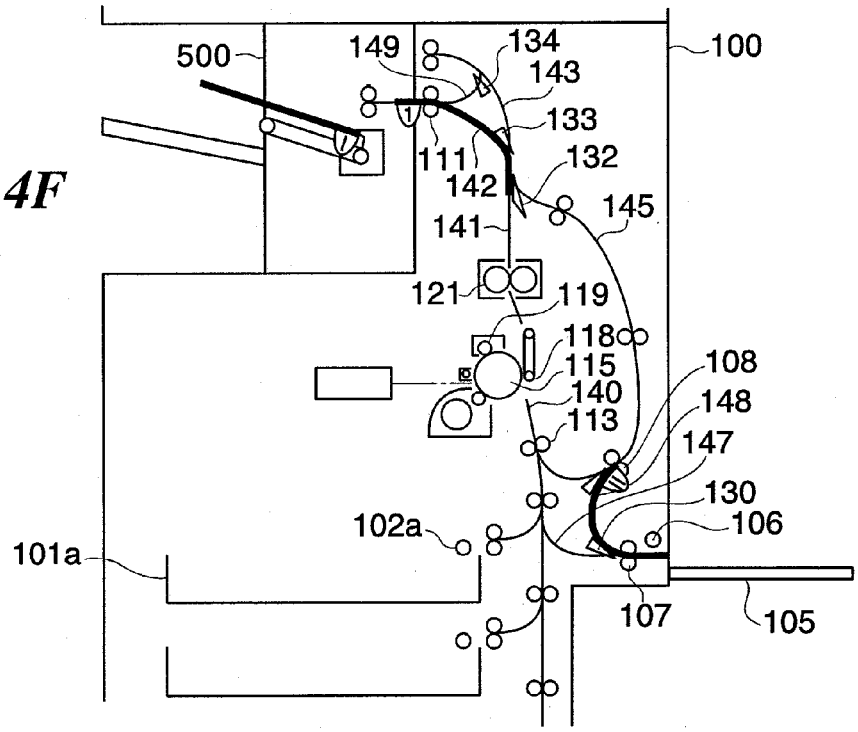
Figure 14G:
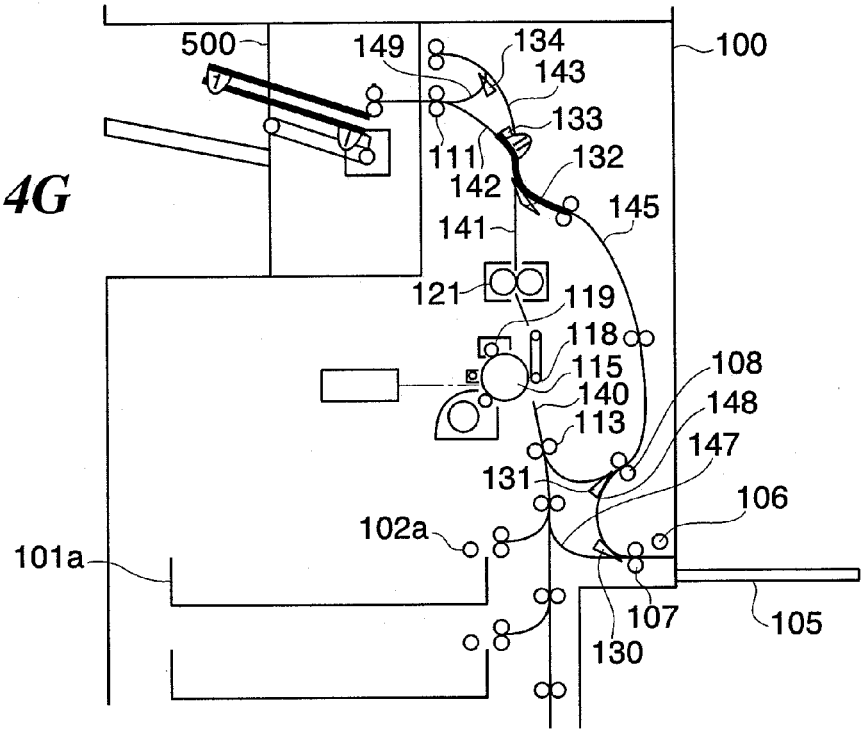
Figure 14H:
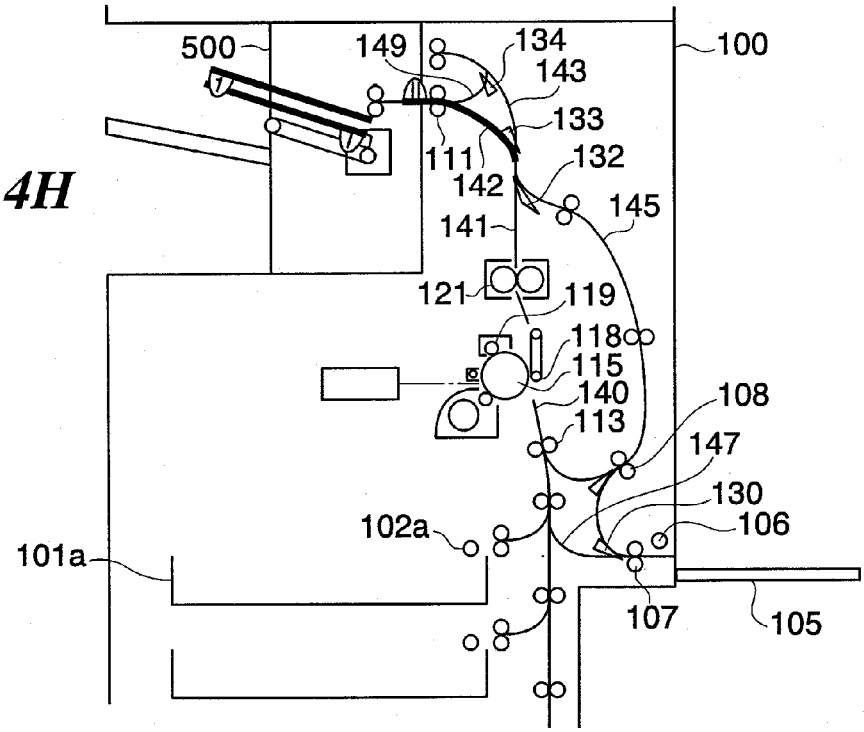
Figure 14I:
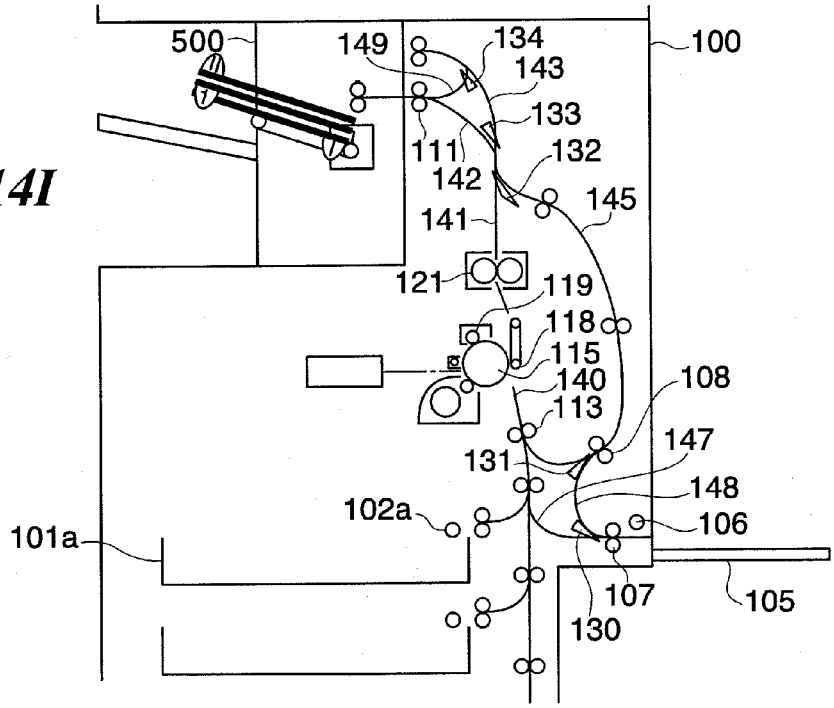
Figure 15:
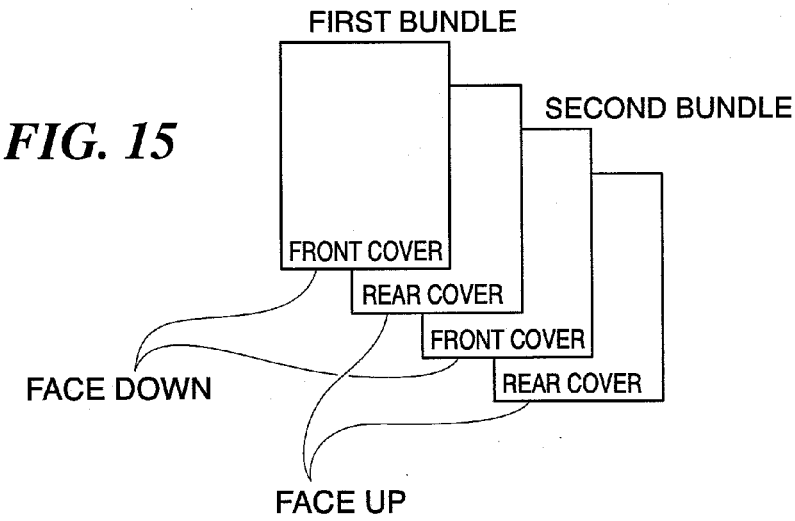
FIG. 15 is a diagram showing insertion sheets for a front cover that are placed face-down on the manual feed tray and insertion sheets for a rear cover that are placed face-up.

The insertion sheet (I) inserted at the first page as the front cover is conveyed into the printer 100 by the manual feeding roller 106 and the manual feed separation rollers 107 and is guided to the conveying path 148 by the flapper 130 (see FIG. 14A). The insertion sheet (I) is conveyed until a leading edge thereof abuts the double-sided conveying rollers 108. In the same way as the registration roller 113, the double-sided conveying rollers 108 correct any skewing of the insertion sheet (I) fed from the manual feed tray 105. After this, the insertion sheet (I) is guided by the flappers 132, 133 to the conveying path 142 (see FIG. 14B), and is conveyed via the discharge roller 111 from the printer 100 to the finisher 500 in a face-down state (see FIGS. 14C, 14D). In this way, in the sheet conveying operation in "mode II", productivity is improved compared to the sheet conveying operation in "mode I" by an amount corresponding to a front-rear inverting process being unnecessary for the insertion sheets for the front cover.

At the same time as the insertion sheet (I) is conveyed to the finisher 500, a sheet conveyed from the cassette 101*a* by the feeding roller 102*a* is conveyed to the registration roller 113, then conveyed from the transfer section 118 to the fixing section 121, and is guided to the conveying path 142 by the flapper 133 (see FIGS. 14C to 14F). The sheet on which image formation has been carried out is then discharged via the discharge roller 111 from the printer 100 to the finisher 500 in a face-down state.

Next, the insertion sheet (II) inserted at the third page as the rear cover is conveyed into the printer 100 by the manual feeding roller 106 and the manual feed separation rollers 107 and is guided to the conveying path 148 by the flapper 130. The insertion sheet (II) is conveyed until a leading edge thereof abuts the double-sided conveying rollers 108. As described above, in the same way as the registration roller 113, the double-sided conveying rollers 108 correct any skewing of the insertion sheet (II) fed from the manual feed tray 105. After this, the insertion sheet (II) is guided by the flappers 132, 133 via the conveying path 145 to the conveying path 142 (see FIG. 14G), and is conveyed via the discharge roller 111 from the printer 100 to the finisher 500 in a face-up state (see FIGS. 14H, 14I).

Figure 16:
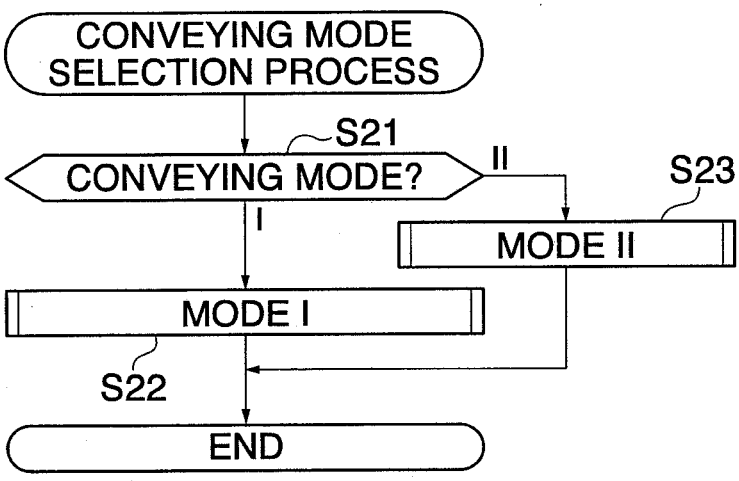
FIG. 16 is a flowchart showing the procedure of a sheet conveying mode selection process.

FIG. 16 is a flowchart showing the procedure of a conveying mode selection process. A program for this process is stored in the ROM 152 inside the CPU circuit 150 and is executed by the CPU 151. When an image forming operation starts, the set conveying mode for sheets is determined (a step S21). When the conveying mode is "mode I", a sheet conveying process for "mode I" shown in FIG. 17, described later, is carried out (a step S22). On the other hand, when the conveying mode is "mode II", a sheet conveying process for "mode II" shown in FIG. 18, described later, is carried out (a step S23). After this, the present process is terminated.

Figure 17:
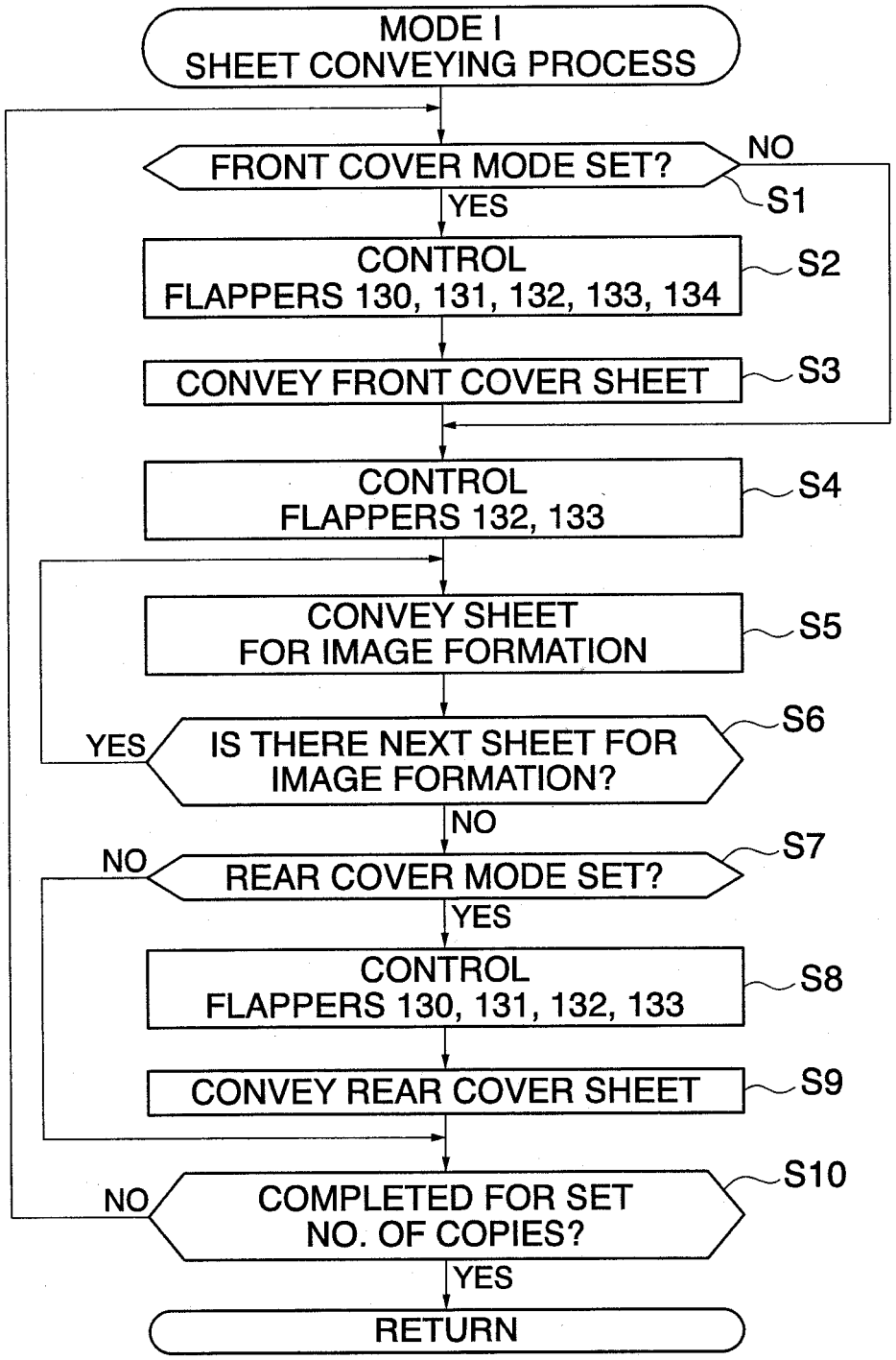
FIG. 17 is a flowchart showing the procedure of a sheet conveying process for "mode I" in a step S22 in FIG. 16.

FIG. 17 is a flowchart showing the procedure of the sheet conveying process for "mode I" in the step S22 of the conveying mode selection process shown in FIG. 16. When the sheet conveying process for "mode I" starts, first it is determined whether "front cover mode" is set (step S1). When "front cover mode" is set, the flappers 130, 131, 132, 133, and 134 are controlled (step S2), and then the insertion sheet (I) for the front cover is conveyed from the manual feed tray 105 (step S3). At this time, as described above, the orientation of the flapper 134 is switched so that the insertion sheet (I) is guided from the conveying path 143 to the inverting path 149. After this, the process proceeds to a step S4. On the other hand, when it is determined in the step S1 that "front cover mode" is not set, the process proceeds directly to the step S4.

After this, the flappers 132, 133 are controlled (step S4), and a sheet that has been conveyed from the cassette 101*a* and on which an image has been formed is conveyed to the finisher 500 (step S5). Next, it is determined whether there is a sheet on which image formation is to be carried out next (step S6), and when there is a sheet on which image formation is to be carried out, the process returns to the step S5 to have the sheet on which image formation has been carried out conveyed. On the other hand, when it is determined in the step S6 that there is no sheet on which image formation is to be carried out next, it is determined whether "rear cover mode" is set (step S7). When "rear cover mode" is not set, the process proceeds directly to a step S10. On the other hand, when "rear cover mode" is set, the flappers 130, 131, 132, and 133 are controlled (step S8), and then the insertion sheet (II) for the rear cover is conveyed (step S9). At this time, as described above, the orientation of the flapper 133 is switched so that the insertion sheet (II) is guided via the double-sided conveying path 145 to the conveying path 142. After this, it is determined whether the bundle-generating operation has been carried out for the number of copies set using the operation display section 600 (step S10), and when this is the case, the present process is terminated. On the other hand, when there are still remaining copies, the process returns to the step S1 and the same process are repeated. By doing so, a sheet bundle such as those shown in FIG. 11A described above is produced on the finisher 500.

Figure 18:
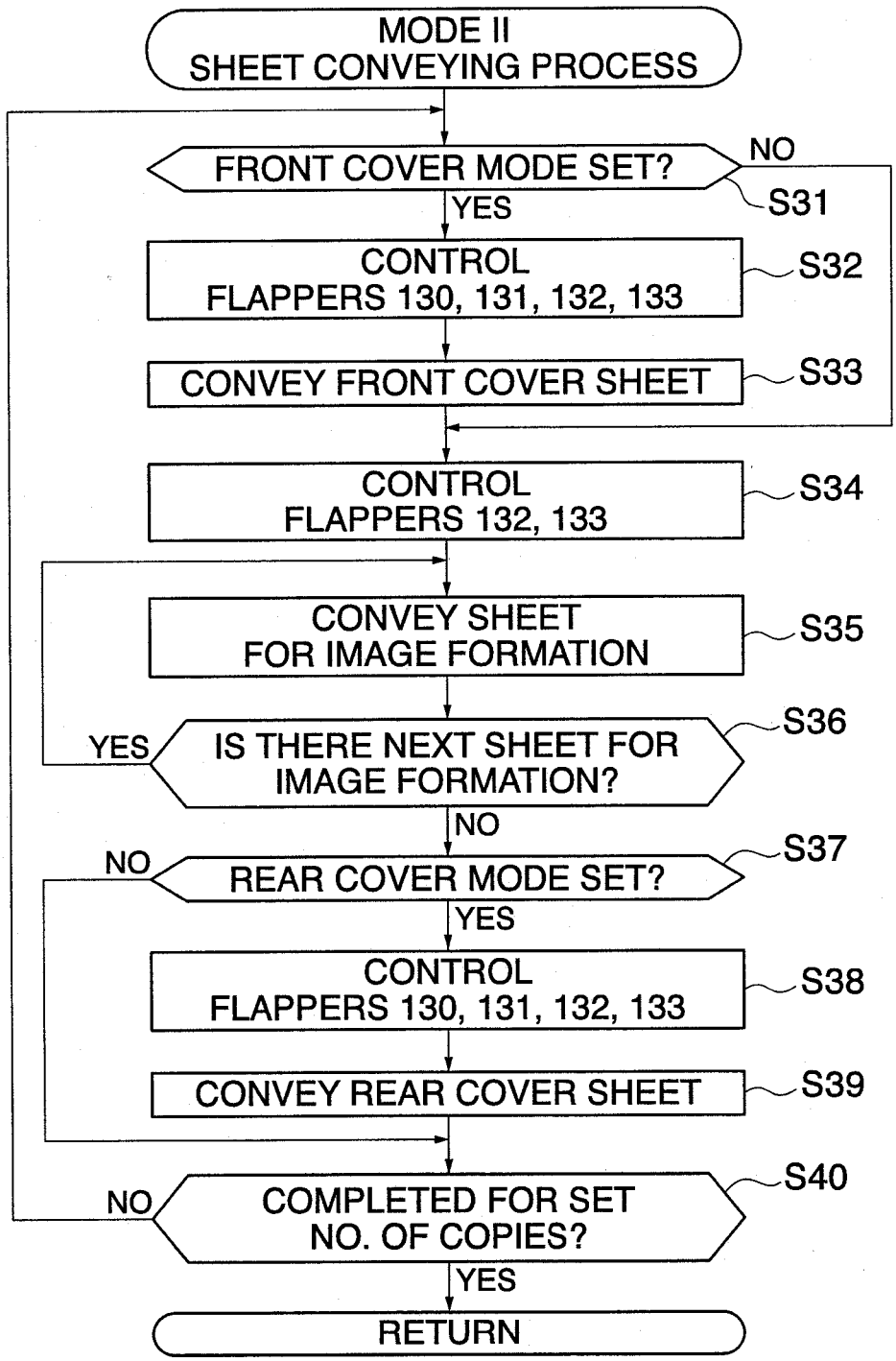
FIG. 18 is a flowchart showing the procedure of a sheet conveying process for "mode II" in a step S23 in FIG. 16.

FIG. 18 is a flowchart showing the procedure of the sheet conveying process for "mode II" in the step S23 of the conveying mode selection process shown in FIG. 16. When the sheet conveying process for "mode II" starts, first it is determined whether "front cover mode" is set (step S31). When "front cover mode" is set, the flappers 130, 131, 132, and 133 are controlled (step S32), and the insertion sheet (I) for the front cover is conveyed from the manual feed tray 105 (step S33). At this time, as described above, the orientation of the flapper 133 is switched so that the insertion sheet (I) is guided via the double-sided conveying path 145 to the conveying path 142. After this, the process proceeds to a step S34. On the other hand, when it is determined in the step S31 that "front cover mode" is not set, the process proceeds directly to the step S34.

After this, the flappers 132 and 133 are controlled (step S34), and a sheet that has been conveyed from the cassette 101*a* and on which an image has been formed is conveyed to the finisher 500 (step S35). Next, it is determined whether there is a sheet on which image formation is to be carried out next (step S36), and when there is a sheet on which image formation is to be carried out, the process returns to the step S35 to have the sheet on which image formation has been carried out conveyed. On the other hand, when it is determined in the step S36 that there is no sheet on which image formation is to be carried out, it is determined whether "rear cover mode" is set (step S37).

When "rear cover mode" is set, the flappers 130, 131, 132, and 133 are controlled (step S38), and the insertion sheet (II) for the rear cover is conveyed (step S39). At this time, in the same way as for the insertion sheet (I), the orientation of the flapper 133 is switched so that the insertion sheet (II) is guided via the double-sided conveying path 145 to the conveying path 142. After this, the process proceeds to a step S40. On the other hand, when "rear cover mode" is not set, the process proceeds directly to the step S40.

It is next determined whether the operation has been carried out for the number of copies set using the operation display section 600 (step S40), and when there are still remaining copies, the process returns to the step S31. On the other hand, when the operation has been carried out for all of the copies, the present process is terminated. By doing so, a sheet bundle such as that shown in FIG. 11A described above is produced on the finisher 500.

In this way, according to the image forming apparatus according to the first embodiment, in the sheet conveying process for "mode I", the insertion sheets for the front cover and the insertion sheets for the rear cover are set with the same orientation on the manual feed tray 105 without setting the insertion sheets so that the image-formed surfaces thereof alternately face up and down. That is, the insertion sheets for the front cover and the insertion sheets for the rear cover can be placed with the same orientation (for example, face-up) on the manual feed tray 105 provided on the image forming apparatus 10. The operability of the apparatus can therefore be improved. Also, since a single manual feed tray is sufficient for setting the insertion sheets for the front cover and the insertion sheets for the rear cover, the apparatus can be miniaturized and an increase in cost can be suppressed.

Also, since switching can be made between "mode I" and "mode II", when the user gives priority to productivity, the insertion sheets for the front cover and the insertion sheets for the rear cover are set respectively face-down and face-up on the manual feed tray 105 of the image forming apparatus 10 and neither sheet passes through the conveying path 143 and the inverting path 149, so that the efficiency of the conveying operation, and in turn the productivity of the production of sheet bundles, can be improved.

Although an example where the insertion sheets for the front cover and the insertion sheets for the rear cover are set face up on the manual feed tray has been given in the above embodiment, the insertion sheets for the front cover and the insertion sheets for the rear cover may be set face down on the manual feed tray, and in this case, the insertion sheets for the front cover are conveyed to the intermediate processing tray of the finisher 500 in the face-down state without being inverted, with the insertion sheets for the rear cover being inverted to become face up and then conveyed to the intermediate processing tray of the finisher 500. By doing so, there is increased freedom when setting the insertion sheets on the manual feed tray, which improves the usability of the apparatus. In addition, although an example where the insertion sheets are inserted from the manual feed tray has been given in the above embodiment, it is also possible to apply the present invention to the case where the insertion sheets are placed on an inserter tray, not shown, attached to the finisher 500 and the sheets are fed one at a time.

Figure 19:
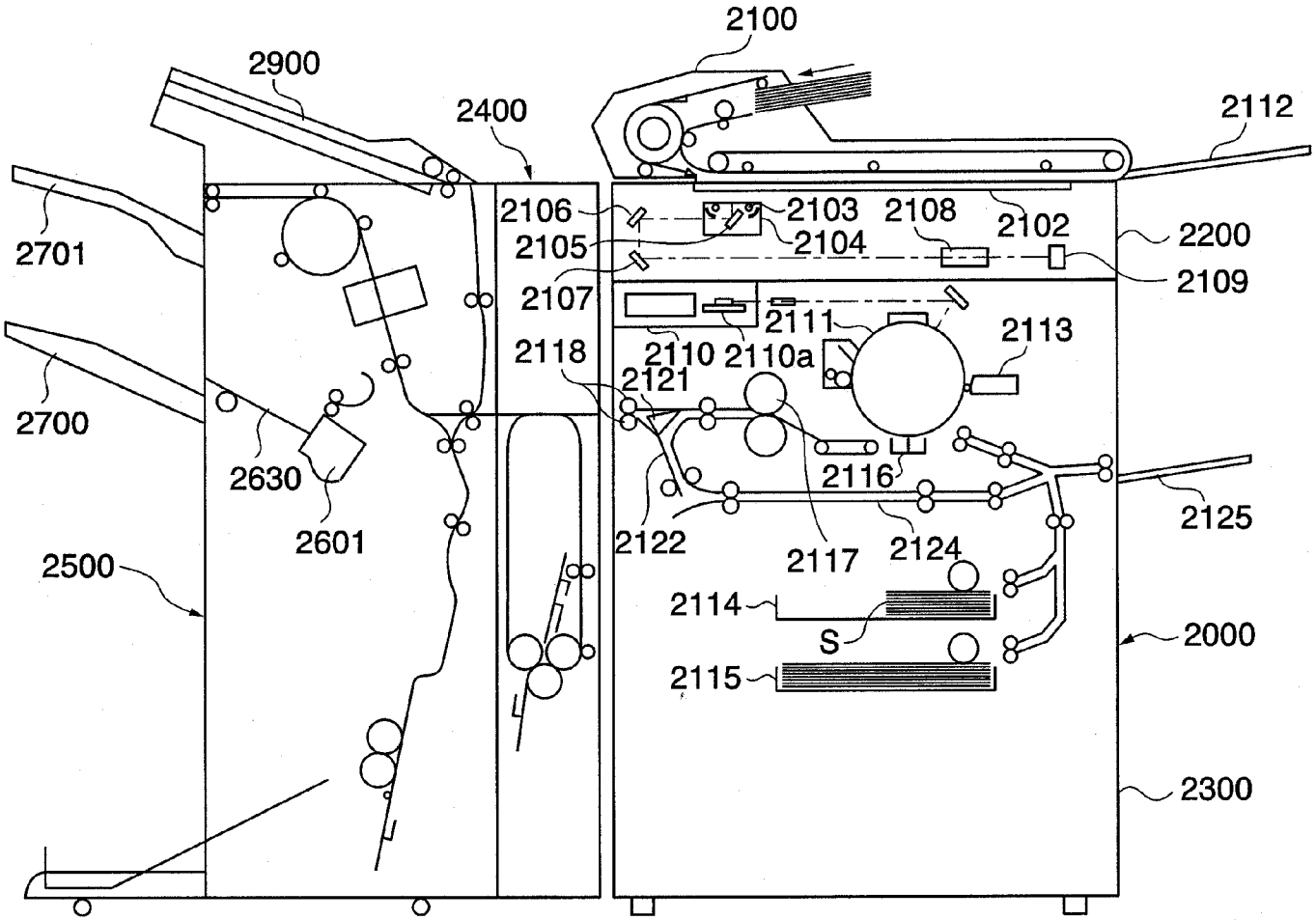
FIG. 19 is a diagram showing the construction of an image forming system comprised of an image forming apparatus and a sheet processing apparatus according to a second embodiment of the present invention.

FIG. 19 is a diagram showing the construction of an image forming system comprised of an image forming apparatus and a sheet processing apparatus according to a second embodiment of the present invention. The image forming apparatus 2000 is comprised of an image reader 2200, and a printer 2300. An original feeding device 2100 is mounted on the image reader 2200. The original feeding device 2100 feeds set originals leftward as viewed in FIG. 19 one at a time in order from an uppermost original, conveys the originals via a curved path over a platen glass 2102 from left to right, and then discharges the originals onto a discharge tray 2112. At this time, a scanner unit 2104 is fixed at a predetermined position, and by passing an original over the scanner unit 2104 from left to right, an operation that reads the original is carried out. This reading operation is called "moving original reading method". When the original passes over the scanner unit 2104, light from a lamp 2103 inside the scanner unit 2104 is irradiated onto the original and light reflected from the original is guided via mirrors 2105, 2106, and 2107 and a lens 2108 to an image sensor 2109. Note that it is also possible to read the original by having the original conveyed by the original feeding device 2100 stop on the platen glass 2102 and then moving the scanner unit 2104 from left to right. This reading operation is called "stationary original reading method". When an original is read without using the original feeding device 2100, the user lifts up the original feeding device 2100 and sets the original on the platen glass 2102. In this case, a reading operation is carried out according to the stationary original reading method.

After image processing has been carried out on the image of the original read by the image sensor 2109, an image signal for the image is sent to an exposure controller 2110. The exposure controller 2110 outputs laser light in accordance with the image signal. When the laser light is irradiated onto a photosensitive drum 2111, an electrostatic latent image is formed on the photosensitive drum 2111. The electrostatic latent image on the photosensitive drum 2111 is developed by a developing unit 2113. The developer (toner) on the photosensitive drum 2111 is transferred by a transfer section 2116 onto a sheet fed from one of cassettes 2114, 2115, a manual feeding unit 2125, and a double-sided conveying path 2124.

The sheet onto which the developer has been transferred is conveyed to a fixing section 2117 and a fixing process for the developer is carried out by the fixing section 2117. The sheet that has passed the fixing section 2117 is temporally guided to a path 2122 by a flapper 2121. After a trailing end of the sheet has passed the flapper 2121, the conveying direction of the sheet is reversed (the sheet is switched back) and the sheet is guided to a discharge roller 2118 by the flapper 2121. By doing so, the sheet is discharged from the printer 2300 by the discharge roller 2118 in a state where the surface on which an image has been formed faces down. This discharge operation is called "inverted discharge". By discharging sheets face down, in the case where images are formed in order from a first page, such as when images of originals read using the original feeding device 2100 are printed and when image data outputted from a computer is printed, the sheets on which images have been formed will be discharged in the correct page order.

It should be noted that when image formation is carried out on a stiff sheet, such as an OHP sheet, fed from the manual feeding unit 2125, the sheet is not guided to the path 2122 and is discharged from the discharge roller 2118 in a state where the surface with the formed image faces up. Also, when images are formed on both surfaces of a sheet, the sheet is guided straight to the discharge roller 2118 from the fixing section 2117, and immediately after a trailing end of the sheet has passed the flapper 2121, the sheet is switched back, and is guided to the double-sided conveying path 2124 by the flapper 2121.

Here, when the stationary original reading method is carried out, in the sub-scanning direction, an original is read from the right end of the original to the left end and an image is formed in order from the right end of the original. On the other hand, regarding the main scanning direction, an image read in a predetermined direction by the image sensor 2109 is sent as it is to the exposure controller 2110 so that an image is formed without becoming a mirror image. However, when the moving original reading method is carried out, an original is read from the left end of the original to the right end so that the sub-scanning direction becomes opposite to when the stationary original reading method is carried out. If the read image were sent to the exposure controller 2110 in the read state, a mirror image would be formed. For this reason, a mirror image process is carried out by switching the main scanning direction to the opposite direction so that an image that would be formed as a mirror image is corrected to a proper image. After this, by sending the corrected image to the exposure controller 2110, the proper image is formed.

Also, as described above, by carrying out inverted discharge, the trailing end of the sheet becomes the left end of an image, so that by carrying out a binding process on the trailing ends, the left ends of images are bound. Note that although it is possible to carry out a mirror image process by switching the sub-scanning direction to the opposite direction, in view of the inability to carry out the mirror image process until the reading is complete for one entire page and the left ends of images being bound by a binding process performed on the trailing ends after inverted discharge, it is more preferable to switch the main scanning direction.

The sheets discharged from the discharge roller 2118 are fed into a folding apparatus 2400. The folding apparatus 2400 carries out a process that folds the sheets in a Z shape. When a folding process has been designated for sheets that are A3 or B4 size, such sheets are subjected to the folding process by the folding apparatus 2400, with other sheets being fed directly into a finisher 2500. The finisher 2500 carries out a stitching process, a punching process and/or the like on the sheets.

Figure 20:
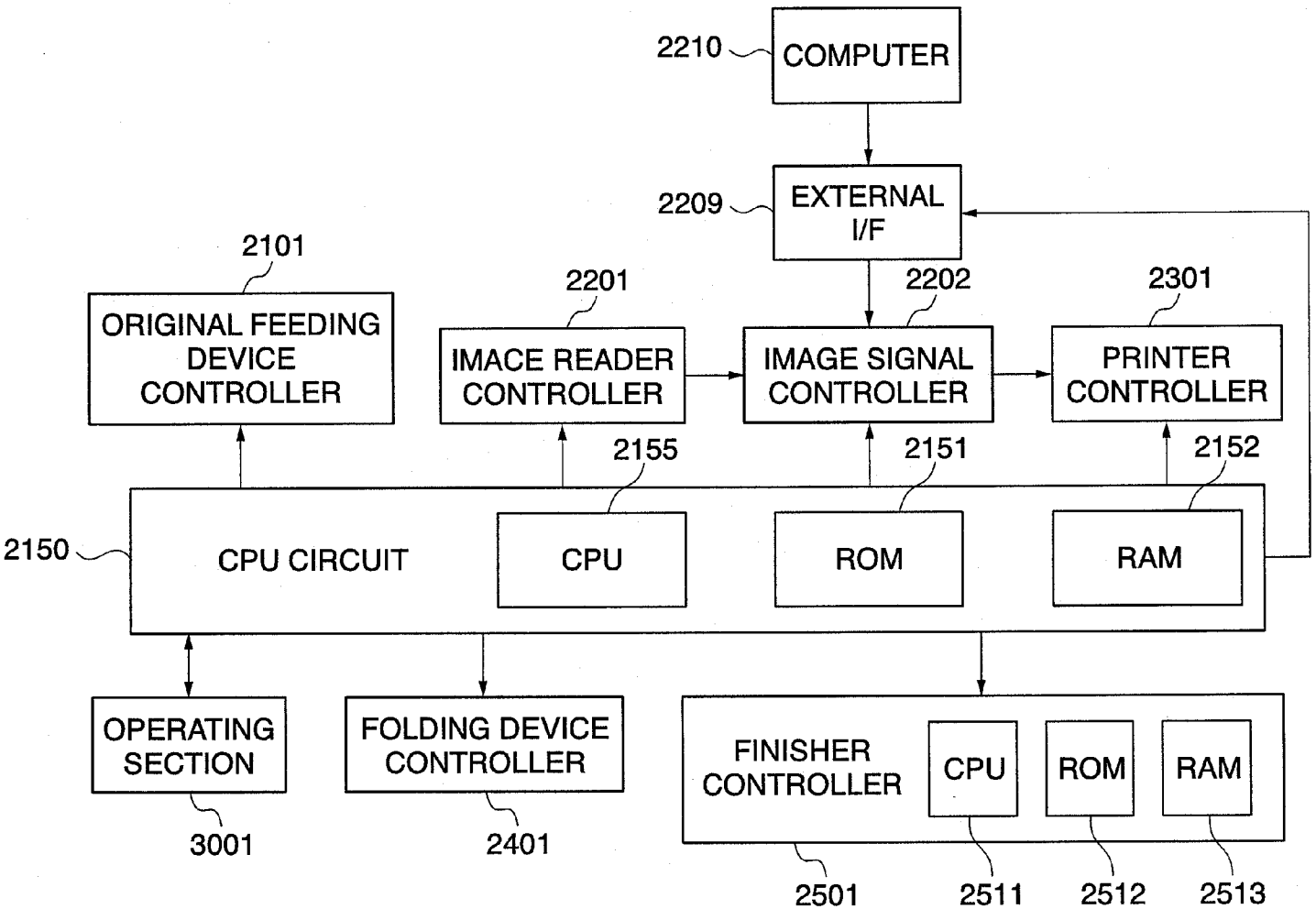
FIG. 20 is a block diagram showing the construction of a controller that controls the image forming system shown in FIG. 19.

FIG. 20 is a block diagram showing the construction of a controller that controls the entire image forming system. The controller includes a CPU circuit 2150, an original feeding device controller 2101, an image reader controller 2201, an image signal controller 2202, a printer controller 2301, an operating section 3001, a folding device controller 2401, and a finisher controller 2501. The image signal controller 2202 is connected to an external computer 2210 via an external interface (I/F) 2209.

The CPU circuit 2150 includes a CPU 2155, a ROM 2151, and a RAM 2152 and carries out overall control of the respective parts of the image forming system by having the CPU 2155 execute control programs stored in the ROM 2151. The RAM 2152 temporarily stores control data and is used as a work area for computational processes when the CPU 2155 executes the control programs.

The original feeding device controller 2101 controls the original feeding device 2100. The image reader controller 2201 controls the image reader 2200. The printer controller 2301 controls the printer 2300. The folding device controller 2401 controls the folding apparatus 2400. The finisher controller 2501 includes a CPU 2511, a ROM 2512, and a RAM 2513 and controls the finisher 2500 and an inserter unit 2900 by having the CPU 2511 execute control programs stored in the ROM 2512. The RAM 2513 temporarily stores control data and is used as a work area for computational processes when the CPU 2511 executes the control programs. An insert mode key, not shown, that can set "insert mode" is provided on an operating section 3001, and by pressing this insert mode key, it is possible to set and cancel the insert mode.

The external I/F 2209 provides interface for the computer 2210, expands print data into image data, and outputs the image data to the image signal controller 2202. The image signal read by the image sensor 2109 is outputted to the image signal controller 2202 from the image reader controller 2201, and image data outputted from the image signal controller 2202 to the printer controller 2301 is inputted to the exposure controller 2110.

Figure 21:
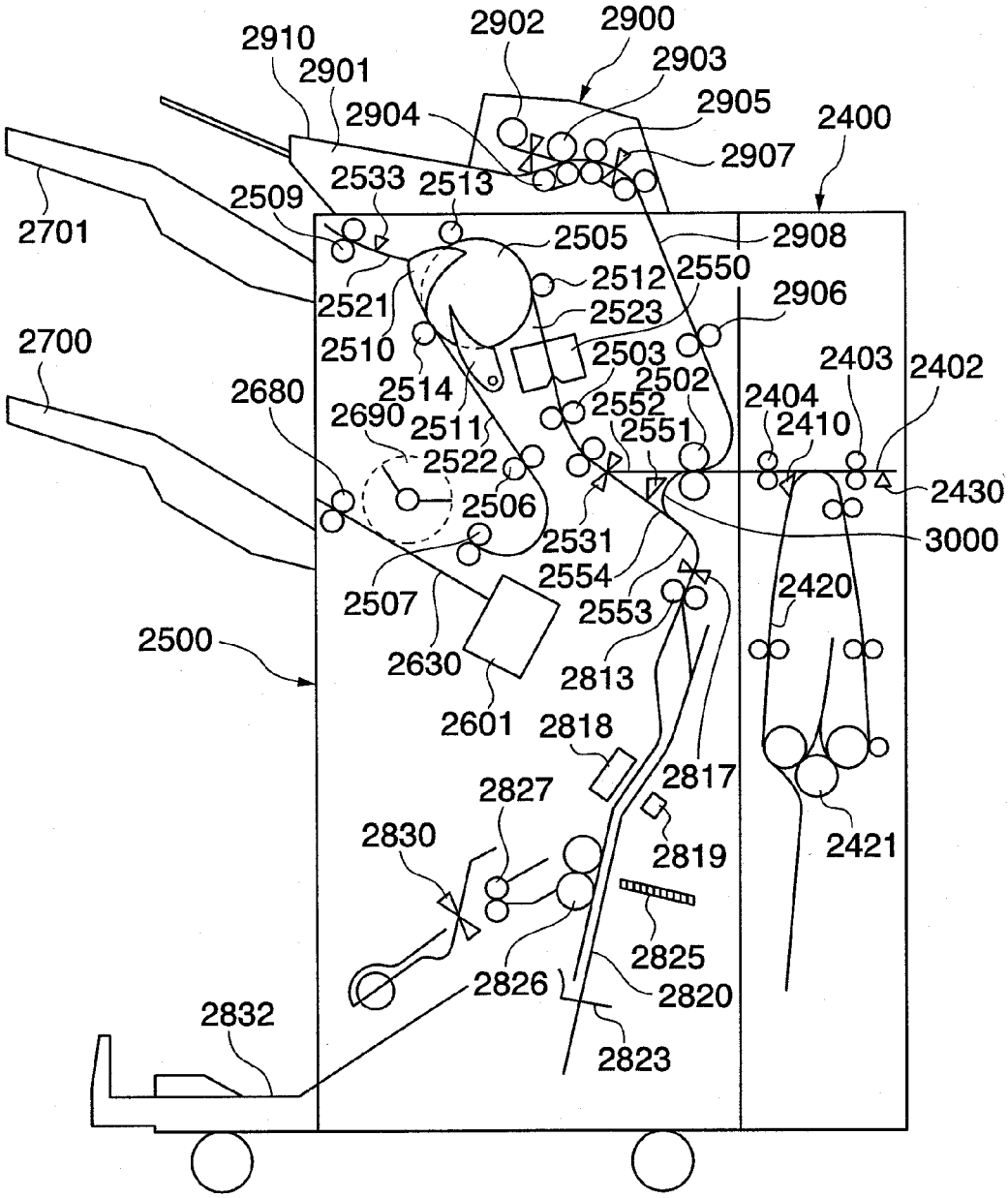
FIG. 21 is a diagram showing the construction of the sheet processing apparatus shown in FIG. 19.

FIG. 21 is a diagram showing the construction of the sheet processing apparatus of an image forming system 2000. The sheet processing apparatus is comprised of the folding apparatus 2400 and the finisher 2500. In the folding apparatus 2400, a sheet discharged from the printer 2300 is guided and conveyed to a folding conveying horizontal path 2402. At this time, the presence of the sheet ("sheet on/off") on the folding conveying horizontal path 2402 is detected by a folding conveying horizontal path sensor 2430. When the folding process is not carried out on the conveyed sheet, a folding path selecting flapper 2410 is turned off and the sheet is conveyed directly to the finisher 2500. On the other hand, when the folding process is carried out on the sheet, the folding path selecting flapper 2410 is turned on and the sheet is conveyed to a folding conveying path 2420, is subjected to the folding process, and then the folding path selecting flapper 2410 is turned off to convey the sheet to the finisher 2500.

In the finisher 2500, the conveyed sheet is fed into a saddle selection flapper 2551. When the saddle selection flapper 2551 is on, the sheet is sent to a saddle conveying path 2553 that carries out a stitching process.

When the saddle selection flapper 2551 is off, the conveyed sheet is detected by an intake sheet conveying path sensor 2531 and is guided to a punch unit 2550 by a pair of conveying rollers 2503. The punch unit 2550 carries out hole punching on the conveyed sheet as necessary. In addition, the conveyed sheet is pressed by a large conveying roller 2505 and pressing rollers 2512, 2513 that contact the large conveying roller 2505. The sheet is discharged via a sample path 2521 onto a sample tray 2701 by a discharge roller 2509. A switching flapper 2510 switches a conveying destination of the sheet between the sample path 2521 and a sort path 2522. A switching flapper 2511 switches the conveying destination of the sheet between the sort path 2522 and a buffer path 2523 where sheets are temporarily stored.

A sheet conveyed via the sort path 2522 is discharged onto an intermediate tray (processing tray) 2630 by a discharge roller 2507 and is thereby temporarily placed on the intermediate tray 2630. In the processing tray 2630, a sheet process for aligning, stapling, and the like is carried out. A stapler 2601 binds the sheets placed on the processing tray 2630 into a bundle, and is freely movable in a direction substantially perpendicular to the sheet conveying direction. The stapler 2601 moves along the end of sheets and carries out a stapling process that binds the sheets at two places, for example. A bundle of sheets that has been subjected to the stapling process and placed on the processing tray 2630 is conveyed as a bundle by a bundle discharge roller 2680, and is discharged as a bundle onto a stack tray 2700.

Here, the stack tray 2700 and the sample tray 2701 have respectively independent motors and can be independently moved in an up-down direction. The punch unit 2550 has a punching section and a transverse register detecting section. In the punching section, a punch driven by a punch driving motor and a die engage while rotating. During operation, when the trailing end of a sheet is detected, the punch unit 2550 drives the punch driving motor in predetermined timing and punches holes in the sheet being conveyed. At this time, by making the rotational speed of the pair of conveying rollers 2503 mentioned above equal to the rotational speed of the punch and the die, it is possible to punch holes in the sheet being conveyed. The transverse register detecting section is provided with a sensor, not shown, that detects an inner end of the sheet being conveyed, and can position the punch in the transverse direction by having the entire punch moved in the direction perpendicular to the sheet conveying direction (i.e., has the punch moved transversely), having such transverse movement stopped when the inner end of the sheet is detected, and having the punch holes at this position.

Insertion sheets that are to be inserted into recording sheets on which images have been formed are placed on an inserter tray 2910. The inserter 2900 separates sheets one at a time from the top of the insertion sheets placed on the inserter tray 2910, and conveys the insertion sheets into the finisher 2500 via an inserter conveying path 2908. The insertion sheets are then conveyed to a horizontal path 2552 inside the finisher 2500 and are conveyed in that state inside the finisher 2500 and discharged onto a predetermined tray.

In this way, an insertion sheet is fed from the inserter tray 2900 and is conveyed inside the finisher 2500 in desired timing, so that the insertion sheet is inserted between sheets conveyed from the printer 2300, thus carrying out an insert process for a single bundle. As a specific example, one insertion sheet from the inserter 2900 is discharged onto the processing tray 2630 and after this, sheets discharged from the printer 2300 are placed on the processing tray 2630, so that a sheet bundle that has the insertion sheet from the inserter 2900 as a front cover can be produced. Accordingly, in the finisher 2500, it is possible to produce sheet bundles that have sheets on which images have been formed in advance as the front covers, and/or have been subjected to the binding process or punching process.

FIGS. 22A to 22F are diagrams showing a conveying operation for insertion sheets in "mode I" of the sheet processing apparatus. First, insertion sheets (I) for the front cover and insertion sheets (II) for the rear cover are both placed in a face-up state on the inserter tray 2910 (see FIG. 22A). After this, in the same way as in the first embodiment, when a printer controller 1301 starts an image forming operation after "front cover" and "rear cover mode" have been set by the user via the operating section 3001 as shown in FIGS. 10A to 10E, first, an insertion sheet (I) for the front cover is separated by an inserter separation roller 2903 and is conveyed to the inserter conveying path 2908. It should be noted that when "mode I" has been selected, an indication instructing the user to place the insertion sheets for the front cover and the rear cover face up is displayed on an operation display section of the operating section 3001.

Figure 22A:
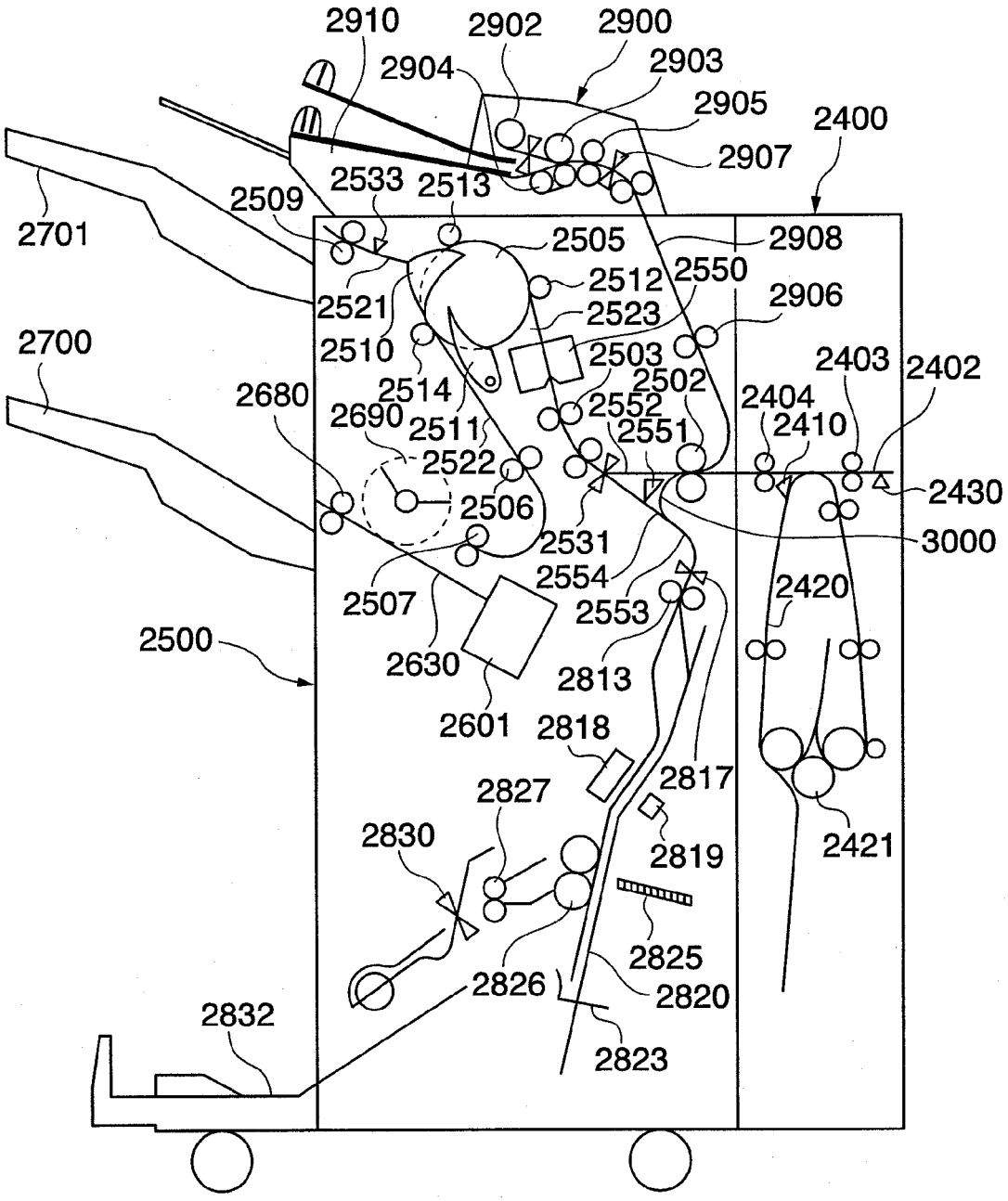
FIGS. 22A to 22F are diagrams showing a conveying operation for insertion sheets in "mode I" of the sheet processing apparatus.
Figure 22B:
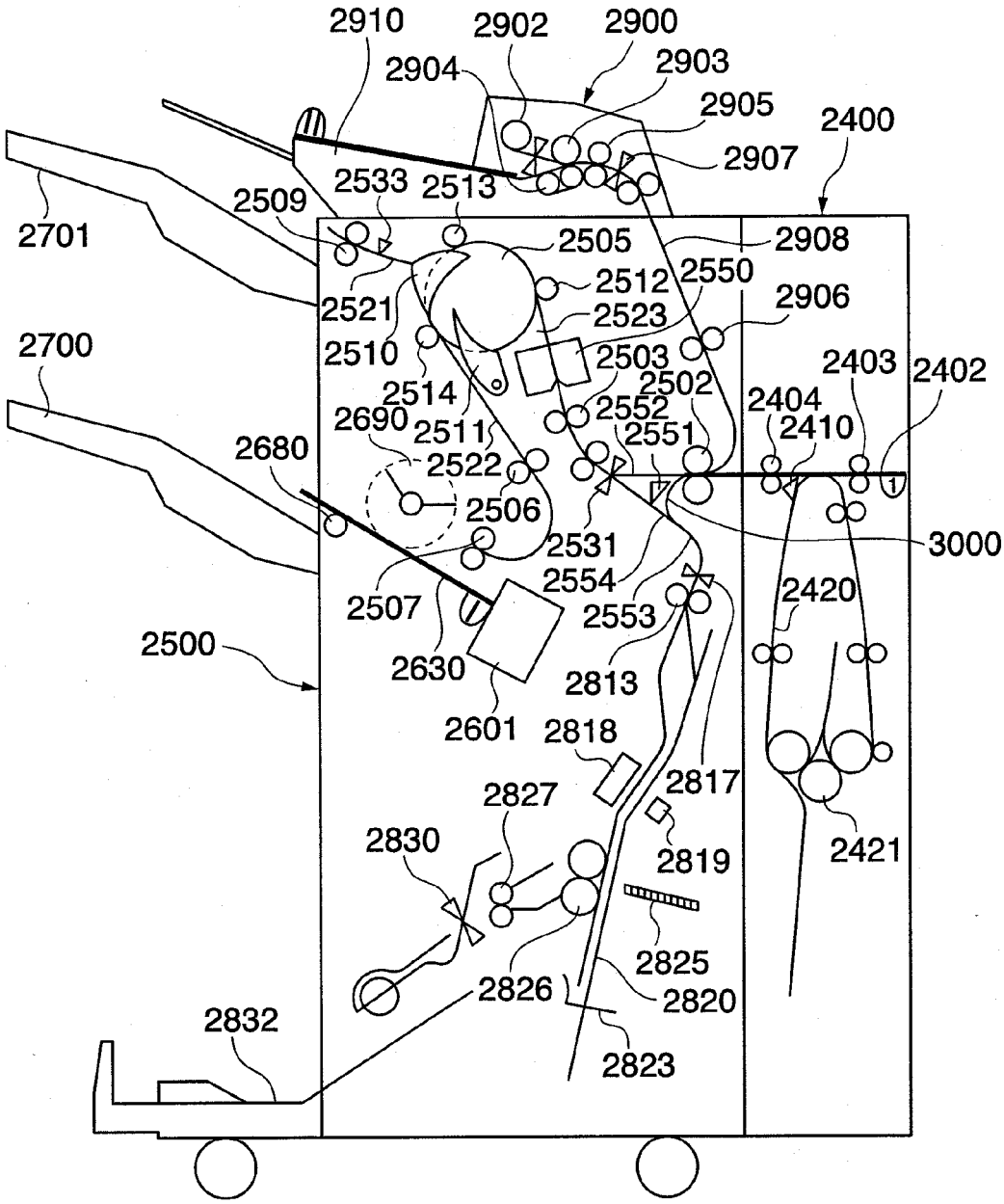
Figure 22C:
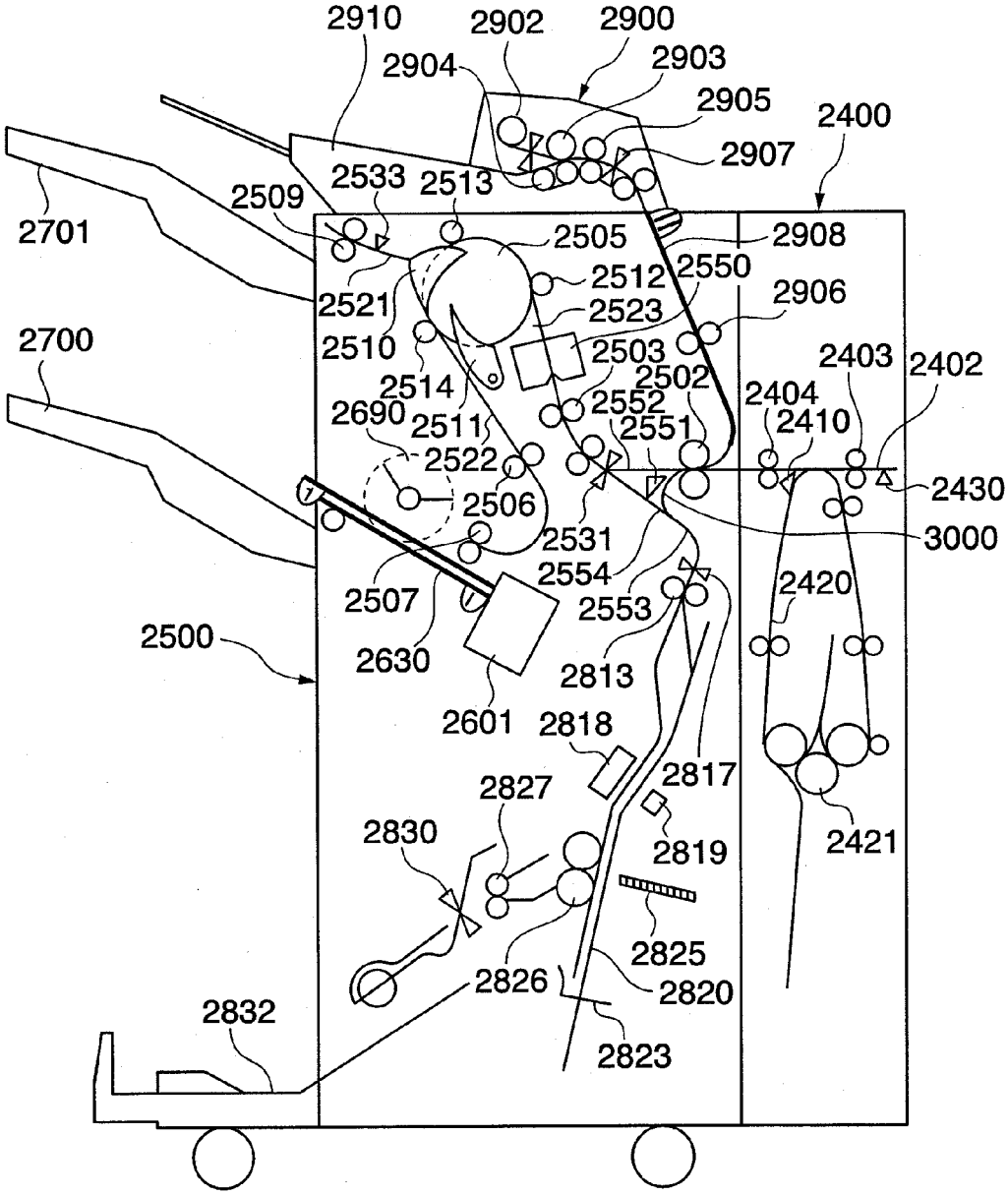
Figure 22D:
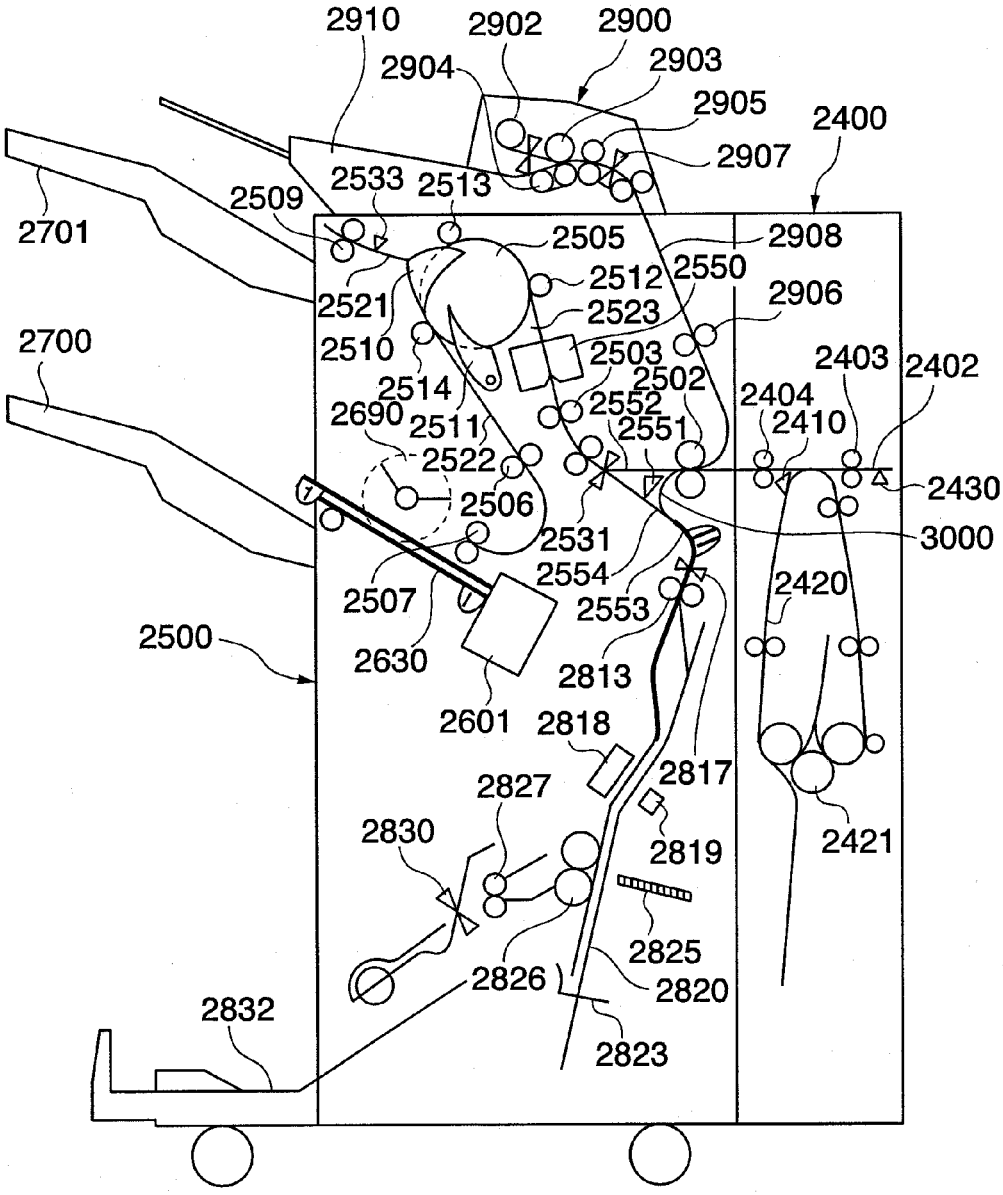
Figure 22E:
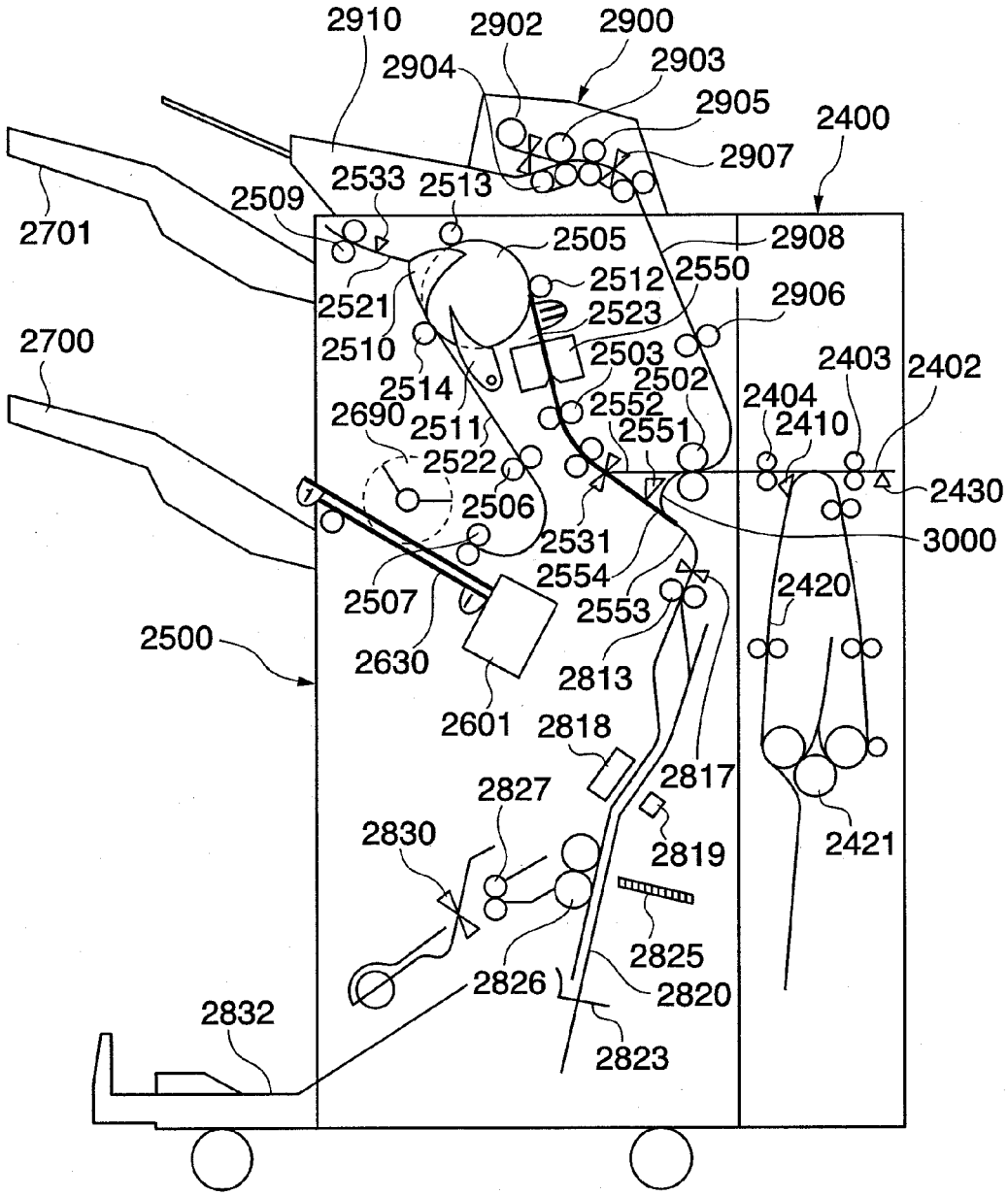
Figure 22F:
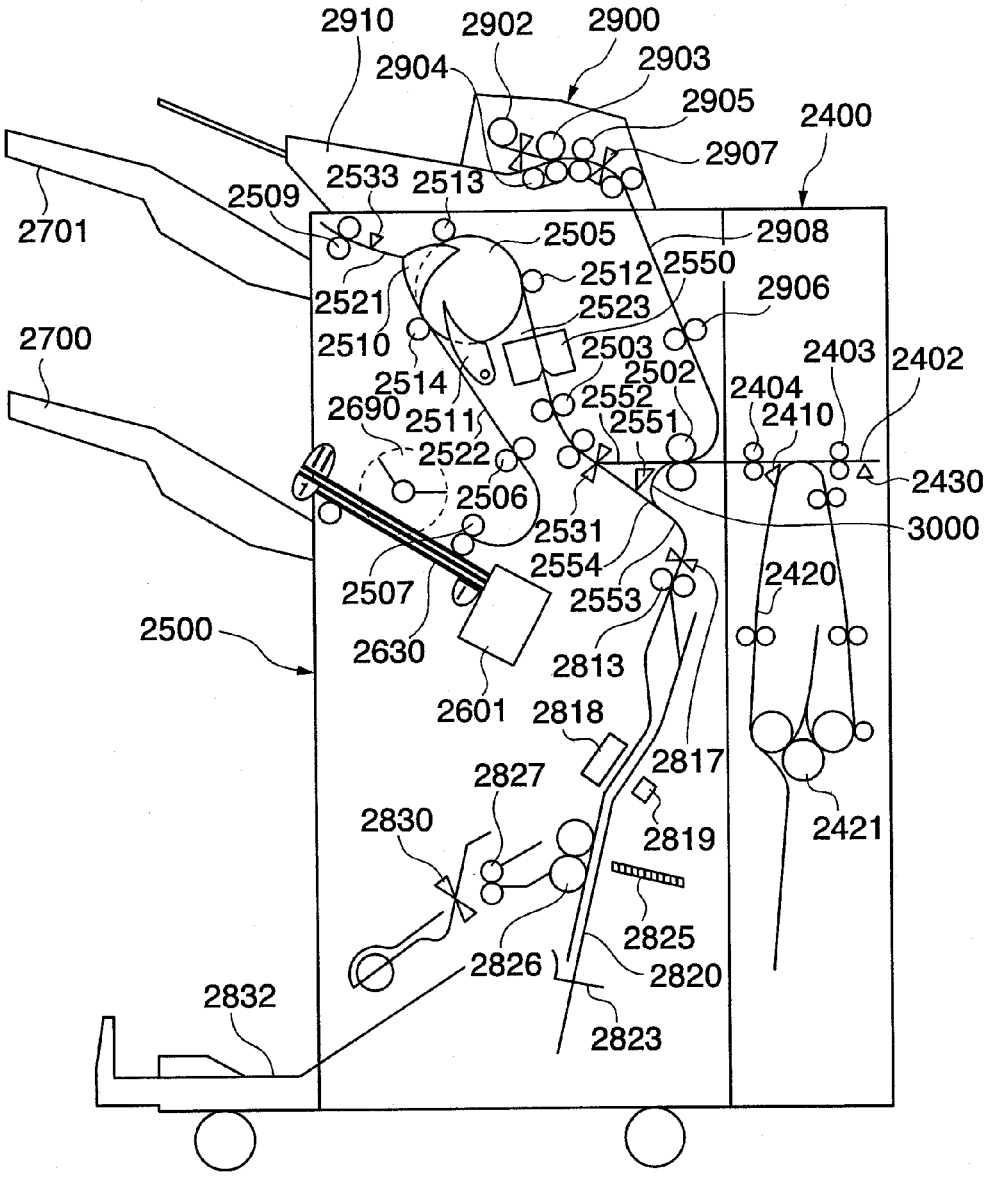

The finisher controller 2501 switches the orientations of the flappers 2551, 2510, 2511 to guide the insertion sheet (I) for the front cover to the processing tray 2630 via the conveying paths 2552, 2522 (see FIG. 22B). After the insertion sheet (I) for the front cover has been conveyed to the processing tray 2630, a sheet (1) on which an image has been formed is conveyed to the folding conveying horizontal path 2402 and is discharged onto the processing tray 2630 in the same way as the insertion sheet (I) for the front cover (see FIG. 22C).

After being separated by the inserter separation roller 2903, an insertion sheet (II) for the rear cover is conveyed to the inserter conveying path 2908. At this time, the finisher controller 2501 changes the orientation of the flapper 2551 to guide the insertion sheet (II) for the rear cover to the saddle conveying path 2553. After the trailing end of the insertion sheet (II) for the rear cover has passed the flapper 2551, the insertion sheet (II) for the rear cover is stopped (see FIG. 22D) and the orientation of the flapper 2551 is switched to guide the insertion sheet (II) for the rear cover to a conveying path 2554 (see FIG. 22E). After this, after the orientations of the flappers 2510, 2511 are switched to guide the insertion sheet (II) for the rear cover to the processing tray 2630, the insertion sheet (II) for the rear cover is placed on the processing tray 2630 (see FIG. 22F).

In the sheet conveying operation in "mode II", priority is placed on the productivity of producing sheet bundles, and insertion sheets (I) for the front cover are placed face up and insertion sheets (II) for the rear cover are placed face down on the inserter tray 2910. Next, the orientation of the flapper 2551 is switched so that in the same way as the insertion sheet (I) for the front cover, the insertion sheet (II) for the rear cover is directly conveyed from the conveying path 2908 to the conveying path 2552 without passing the saddle conveying path 2553. It should be noted that when "mode II" has been selected, an indication instructing the user to place the insertion sheets for the front cover face up and the insertion sheets for the rear cover face down is displayed on the operation display section of the operating section 3001.

A sheet conveying process in the image forming system with the above construction will now be described. In the same way as in the first embodiment, when the image forming operation starts, the CPU 2511 inside the finisher controller 2501 executes a processing program stored in the ROM 2512 to determine the conveying mode for sheets. When a result of this determination is that the conveying mode is "mode I", a sheet conveying process for "mode I" is carried out. On the other hand, when the conveying mode is "mode II", a sheet conveying process for "mode II" is carried out (see FIG. 16).

Figure 23:
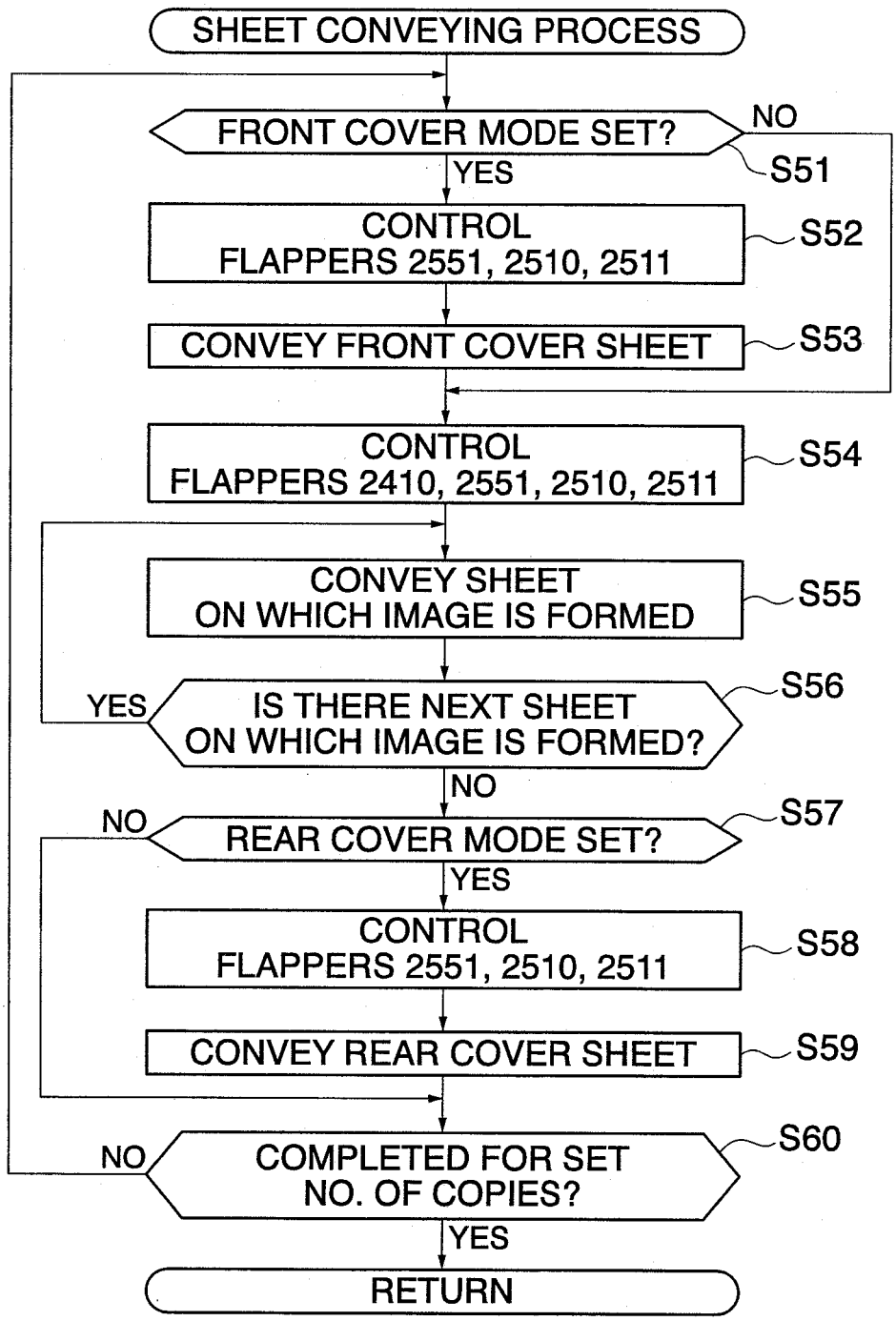
FIG. 23 is a flowchart showing the procedure of a sheet conveying process for "mode I" in the second embodiment.

FIG. 23 is a flowchart showing the procedure of the sheet conveying process for "mode I" in the second embodiment. A program for this process is stored in the ROM 2512 of the finisher controller 2501 and is executed by the CPU 2511. First, the CPU 2511 determines whether "front cover mode" is set (step S51). When "front cover mode" is set, the flappers 2551, 2510, and 2511 are controlled (step S52) and the insertion sheet (I) for the front cover is conveyed from the inserter tray 2910 (step S53). At this time, as described above, the flapper 2551 is switched to guide the insertion sheet (I) for the front cover from the conveying path 2908 directly to the conveying path 2552. After this, the process proceeds to a step S54. On the other hand, when "front cover mode" is not set, the process proceeds directly to the step S54.

The flappers 2410, 2551, 2510, 2511 are controlled (step S54) so that a sheet on which an image has been formed and which has been discharged from the printer 2300 is conveyed to the processing tray 2630 of the finisher 2500 (step S55). After this, it is determined whether there is a next sheet on which an image has been formed (step S56), and when there is the next sheet on which an image has been formed, the process returns to the step S55 and the sheet on which an image has been formed is conveyed in the same way. On the other hand, when there is no next sheet on which an image has been formed, it is determined whether "rear cover mode" is set (step S57).

When "rear cover mode" is set, the flappers 2551, 2510, and 2511 are controlled (step S58) and an insertion sheet (II) for the rear cover is conveyed (step S59). At this time, as described above, the orientation of the flapper 2551 is switched to guide the insertion sheet (II) for the rear cover from the conveying path 2908 to the saddle conveying path 2553. After this, the process proceeds to a step S60. On the other hand, when it is determined in the step S57 that "rear cover mode" is not set, the process proceeds directly to the step S60. It is then determined whether the bundle-generating operation has been carried out for the number of copies set using the operating section 3001 (step S60). When the operation has not been carried out for all of the set number of copies, the process returns to the step S51. When the operation has been carried out for all of the set number of copies, the present process is terminated.

In this way, a sheet bundle such as that shown in FIG. 11A described above is produced on the processing tray 2630. After the sheet bundle has been subjected to post-processing on the processing tray 2630, the sheet bundle is discharged onto the stacker tray 2700 by the bundle discharge roller 2680.

In the procedure of the sheet conveying process for "mode II", the same process as the step S52 during "front cover mode" in the procedure of the sheet conveying process for "mode I" shown in FIG. 23 is carried out in the step S58 during "rear cover mode", but aside from this, the process for "mode II" is the same as for "mode I", and therefore description thereof is omitted.

In this way, according to the second embodiment, the insertion sheets for the front cover and the insertion sheets for the rear cover can be placed with the same orientation (face up) on the inserter tray of the sheet processing apparatus. As a result, it is possible to improve the user operability. Also, a single inserter tray is sufficient, so that the apparatus can be miniaturized and an increase in cost can be suppressed.

In addition, by making it possible to switch between "mode I" and "mode II", when the user gives priority to the productivity of the production of sheet bundles, "mode II" is selected and placing the insertion sheets for the front cover and the insertion sheets for the rear cover are placed respectively in a face-up state and a face-down state on the inserter tray, which makes it possible to have the sheets omit the saddle conveying path 2553, so that high productivity can be achieved.

Although in the above embodiment, an example where both the insertion sheets for the front cover and the insertion sheets for the rear cover are set face up on the inserter tray has been given, both the insertion sheets for the front cover and the insertion sheets for the rear cover may be set face down on the inserter tray. In this case, the insertion sheets for the rear cover may be conveyed onto the processing tray 2630 in a face-up state without being inverted and the insertion sheets for the front cover may be conveyed to the processing tray 2630 in a face-down state after being inverted. By doing so, there is increased freedom when setting the insertion sheets on the inserted tray, so that user-friendliness can be improved.

The present invention is not limited to the above described embodiments and can be applied to any construction that can achieve the functions described in the appended claims or the functions of either of the constructions of the above described embodiments.

It is to be understood that the object of the present invention may also be accomplished by supplying a system or an apparatus with a storage medium in which a program code of software which realizes the functions of either of the above described embodiments is stored, and causing a computer (or CPU or MPU) of the system or apparatus to read out and execute the program code stored in the storage medium.

In this case, the program code itself read out from the storage medium realizes the functions of either of the embodiments described above, and hence the program code and the storage medium in which the program code is stored constitute the present invention.

Examples of the storage medium for supplying the program code include a floppy (registered trademark) disk, a hard disk, a magneto-optical disk, a CD-ROM, a CD-R, a CD-RW, a DVD-ROM, a DVD-RAM, a DVD-RW, a DVD+RW, a magnetic tape, a nonvolatile memory card, and a ROM. Alternatively, the program may be downloaded via a network.

Further, it is to be understood that the functions of either of the above described embodiments may be accomplished not only by executing a program code read out by a computer, but also by causing an OS (operating system) or the like which operates on the computer to perform a part or all of the actual operations based on instructions of the program code.

Further, it is to be understood that the functions of either of the above described embodiments may be accomplished by writing a program code read out from the storage medium into a memory provided on an expansion board inserted into a computer or in an expansion unit connected to the computer and then causing a CPU or the like provided in the expansion board or the expansion unit to perform a part or all of the actual operations based on instructions of the program code.

What is claimed is:

1. A sheet processing apparatus comprising:

an insertion sheet feeding unit configured to feed a plurality of insertion sheets stacked on a feeding tray, the plurality of insertion sheets including a first insertion sheet that constitutes a front cover of a bundle of sheets at one side thereof and a second insertion sheet that constitutes a rear cover of the bundle of sheets at one side thereof, the first insertion sheet and the second insertion sheet being stacked on the feed tray while the second insertion sheet is placed under the first insertion sheet with both the one side of the first insertion sheet and the one side of the second insertion sheet placed facing-up;

a sheet stacking tray on which the bundle of sheets, which constitute the first insertion sheet, the second insertion sheet, and at least one recording sheet, are stacked;

a first conveying section configured to convey one insertion sheet among the plurality of insertion sheets so that one side of the one insertion sheet is placed facing-down on said sheet stacking tray;

a second conveying section convey another insertion sheet among the plurality of insertion sheets so that the one side of the another insertion sheet is placed facing-up on said sheet stacking tray; and a conveying controller configured to control:

said first conveying section to convey the first insertion sheet so that the first insertion sheet is stacked on said sheet stacking tray with the one side of the first insertion sheet placed facing-down; and said second conveying section to convey the second insertion sheet so that the second insertion sheet is stacked on said sheet stacking tray with the one side of the second insertion sheet placed facing-up, when a mode that appends the front cover and the rear cover to the bundle of sheets is selected.

2. The sheet processing apparatus as claimed in claim 1, further comprising:

an image forming section that forms an image on the recording sheet; and a double-sided conveying section that conveys the recording sheet, on one side of which an image has been formed by said image forming section, to said image forming section again, to have an image formed on the other side of the recording sheet by said image forming section, wherein each of said first conveying section and said second conveying section includes said double-sided conveying section.

3. The sheet processing apparatus as claimed in claim 1, wherein the feeding tray is a manual feed tray and the sheet stacking tray is part of a finisher.

4. The sheet processing apparatus as claimed in claim 1, further comprising a stitching processing unit configured to carry out a stitching process on the bundle of sheets comprising the first insertion sheet, the at least one recording sheet, and the second sheets stacked on the at least one recording sheet.

5. The sheet processing apparatus as claimed in claim 1, wherein said first conveying section further conveys a plurality of recoding sheets to said sheet stacking tray.

6. The sheet processing apparatus as claimed in claim 1, further comprising a receiving unit configured to receive a plurality of recording sheets each with an image formed by an image forming apparatus that is connected to the sheet processing apparatus.

7. An image forming apparatus comprising:

an image forming section configured to form an image on a sheet;

an insertion sheet feeding unit configured to feed a plurality of insertion sheets stacked on a feeding tray, the plurality of insertion sheets including a first insertion sheet that constitutes a front cover of a bundle of sheets at one side thereof and a second insertion sheet that constitutes a rear cover of the bundle of sheets at one side thereof, the first insertion sheet and the second insertion sheet being stacked on the feed tray while the second insertion sheet is placed under the first sheet with both the one side of the first insertion sheet and the one side of the second insertion sheet placed facing-up;

a sheet stacking tray on which both the first insertion sheet and the second insertion sheet from said insertion feeding unit, and recording sheets on which images have been formed by said image forming section are stacked;

a first conveying section configured to convey one insertion sheet among the plurality of insertion sheets so that one side of the one insertion sheet is placed facing-down on said sheet stacking tray;

a second conveying section convey another insertion sheet among the plurality of insertion sheets so that the one side of the another insertion sheet is placed facing-up on said sheet stacking tray; and a conveying controller configured to control:

said first conveying section to convey the first insertion sheet so that the first insertion sheet is stacked on said sheet stacking tray with the one side of the first insertion sheet placed facing-down; and said second conveying section to convey the second insertion sheet so that the second insertion sheet is stacked on said sheet stacking tray with the one side of the second insertion sheet placed facing-up, when a mode that appends the front cover and the rear cover to the bundle of sheets is selected.

8. The image forming apparatus as claimed in claim 7, further comprising a stitching processing unit configured to carry out a stitching process on the bundle of sheets comprising the first insertion sheet, the at least one recording sheet, and the second sheets stacked on the at least one recording sheet.

9. The image forming apparatus as claimed in claim 7, wherein said first conveying section further conveys a plurality of recoding sheets to said sheet stacking tray.

* * * * *